US006099998A

United States Patent [19]

Shibata et al.

[11] Patent Number: 6,099,998

[45] Date of Patent: Aug. 8, 2000

[54] ELECTROPHOTOGRAPHIC PHOTORECEPTOR AND A PRODUCTION METHOD OF THE SAME

[75] Inventors: Toyoko Shibata; Akira Kinoshita, both of Hino; Tomoo Sakimura, Hachioji, all of Japan

[73] Assignee: Konica Corporation, Tokyo, Japan

[21] Appl. No.: 09/118,160

[22] Filed: Jul. 16, 1998

[30] Foreign Application Priority Data

| | | | |
|---|---|---|---|
| Jul. 22, 1997 | [JP] | Japan | 9-195582 |
| Jul. 23, 1997 | [JP] | Japan | 9-197074 |
| Jul. 24, 1997 | [JP] | Japan | 9-198581 |
| Apr. 21, 1998 | [JP] | Japan | 10-110787 |

[51] Int. Cl.[7] ..... G03G 5/047

[52] U.S. Cl. ..... 430/59.6; 430/96

[58] Field of Search ..... 430/59.6, 96

[56] References Cited

U.S. PATENT DOCUMENTS

| | | | |
|---|---|---|---|
| 5,312,708 | 5/1994 | Terrell et al. | 430/96 |
| 5,506,081 | 4/1996 | Terrell et al. | 430/96 |
| 5,529,867 | 6/1996 | Terrell et al. | 430/59.6 |
| 5,821,019 | 10/1998 | Nguyen | 430/59.6 |
| 5,858,592 | 1/1999 | Nguyen et al. | 430/59.6 |
| 5,871,877 | 2/1999 | Ong et al. | 430/59.6 |

FOREIGN PATENT DOCUMENTS

| | | |
|---|---|---|
| 0 589 776 | 3/1994 | European Pat. Off. . |
| 0 805 170 | 11/1997 | European Pat. Off. . |
| 58 031 338 | 2/1983 | Japan . |
| 07 319 180 | 8/1995 | Japan . |

*Primary Examiner*—Roland Martin
*Attorney, Agent, or Firm*—Cantor Colburn LLP

[57] ABSTRACT

An electrophotographic photoreceptor is disclosed. The topmost layer comprises a binder comprising a crosslinked resin having, as a recurring unit, (a) a portion comprising a constituent having a fluorine or silicon atom at the side chain, (b) a portion having an aromatic group in the main or side chain, and (c) a portion having a hydroxyl group or an amino group.

10 Claims, 5 Drawing Sheets

ELECTROPHOTOGRAPHIC PHOTORECEPTOR AND A PRODUCTION METHOD OF THE SAME

BACKGROUND OF THE INVENTION

The present invention relates to an electrophotographic photoreceptor employed in copiers, printers and the like, and more specifically to an electrophotographic photoreceptor which exhibits excellent durability.

Thirty years, and more, have passed since electrophotographic copiers were introduced onto the market. In the early years, photoreceptors, comprised of inorganic photoconductive materials such as selenium, zinc oxide, cadmium sulfide, etc., were widely employed. However, in recent years, electrophotographic organic photoconductors have been mainly employed which exhibit lower cost, non-toxicity, excellent processability, and large selection range to match specific requirements.

However, such organic photoreceptors present various problems.

Generally, in order to form an image employing an electrophotographic method, the surface of a photoreceptor is subjected to charging, image exposure, and development to form a toner image; the resulting toner image is transferred onto a transfer material, and is then fixed to obtain an image. After the transfer of the toner image, the photoreceptor is subjected to cleaning of the residual toner and discharging, and is repeatedly utilized over an extended period. Accordingly, the above-mentioned photoreceptor is required to exhibit excellent electrophotographic properties such as charge potential, dark decay potential, residual potential, etc.; excellent physical properties such as printing durability over repeated usage, abrasion resistance, moisture resistance, etc.; excellent durability against ozone generated during corona discharging and image exposure light.

Fatigue degradation of a photoreceptor caused by the repeated usage is considered to be caused by the abrasion and damage of the photoreceptor surface due to friction and adhesion of paper dust onto the surface during each process of the transfer of a toner image formed on the photoreceptor onto a transfer material, separation, and cleaning of the surface of the photoreceptor after the transfer, and furthermore, decomposition, deterioration, etc. of the photosensitive layer during each process of charging, image exposure, discharging subjected to the surface of the photoreceptor.

Accordingly, in order to minimize the fatigue degradation of the organic photoreceptor, improvements in the physical properties of the photosensitive layer are required. The photosensitive layer of the organic photoreceptor is softer than that of the inorganic photoreceptor, and because the photoconductive material is an organic one, the fatigue degradation of the photoreceptor during the repeated usage is more pronounced. Thus, improvement in the binder employed in the photosensitive layer becomes critical.

Proposed for the purpose of improving the mechanical strength of the photoreceptor, for example, are those in which a charge generating material is dispersed into a crosslinking resin such as a urethane resin (Japanese Patent Publication Open to Public Inspection No. 51-23738) and those in which a crosslinking resin is employed in a charge transport layer (Japanese Patent Publication Open to Public Inspection No. 56-48637); and further, Japanese Patent Publication Open to Public Inspection No. 56-48637 discloses a technique in which a protective layer is provided on the photosensitive layer.

Such techniques known in the art improve physical properties. On the contrary, however, some charge transport material is deposited in the charge transport layer due to insufficient compatibility between the charge transport material and the resin. This exhibits a disadvantage which adversely affects electrostatic properties such as sensitivity of the photoreceptor, residual potential, etc. Therefore, recently, a photoreceptor has been proposed which comprises a modified phenoxy resin in which physical properties are improved (Japanese Patent Publication Open to Public Inspection No. 7-160012).

According to inventions mentioned above, results to meet requirements, to some extent, have been obtained for the improvement in mechanical strength of the organic photoreceptor, and compatibility between the resin and the charge transport material. However, in recent years, the improvements in durability of the photoreceptor have been increasingly demanded, and actually, these requirements have not yet been fully met.

SUMMARY OF THE INVENTION

An object of the present invention is to provide a photoreceptor which exhibits high mechanical durability, and improvements in cleaning properties as well as paper dust adhesion properties.

Another object of the present invention is to provide a photoreceptor which exhibits, in addition to the above performance, excellent compatibility with a charge transport material and minimized effect of temperature on the electrical properties.

The present invention and its preferable embodiments are described.

An electrophotographic photoreceptor comprises, at the topmost layer, a binder comprising a crosslinked a resin having, as a recurring unit, (a) a portion comprising a constituent having a fluorine or silicon atom at the side chain, (b) a portion having an aromatic group in the main or side chain, and (c) a portion having a hydroxyl group or an amino group.

The water contact angle of the photosensitive layer of the electrophotographic photoreceptor is preferably not less than 90 degrees.

In the electrophotographic photoreceptor a divalent or higher isocyanate compound as a crosslinking agent is preferably employed.

In the electrophotographic photoreceptor a resin before crosslinking comprises a partial structure represented by general formulas (1) through (8) mentioned below.

General formula (1)

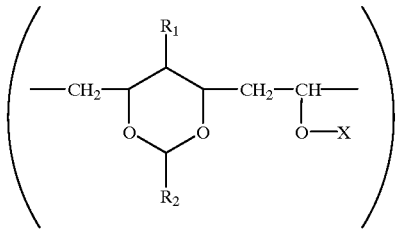

-continued

General formula (2)

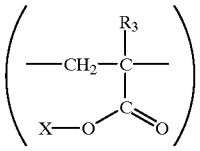

General formula (3)

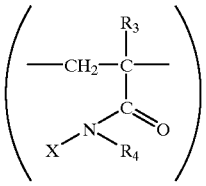

General formula (4)

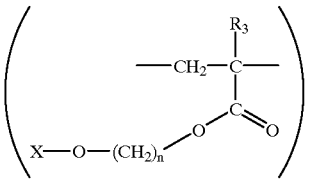

General formula (5)

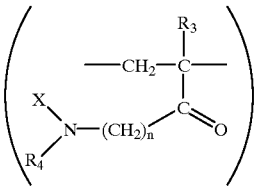

General formula (6)

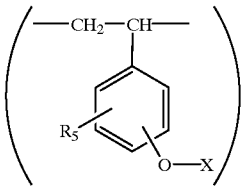

General formula (7)

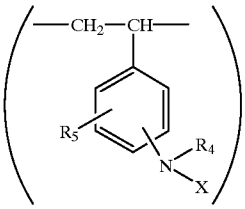

General formula (8)

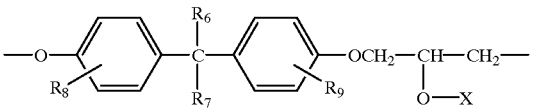

wherein $R_1$ and $R_2$ each represents an alkyl group or an aryl group. In general formulas (1) through (8), X represents a hydrogen atom or an alkyl group, an aryl group, or an organic group comprising a fluorine or silicon atom. Each of the alkyl group, the aryl group and the organic group may combine directly or indirectly via a carbonyl group.

In general formulas (2) through (7), $R_3$ represents a hydrogen atom or an alkyl group having from 1 to 3 carbon atoms; $R_4$ represents a hydrogen atom, an alkyl group, or an aryl group; $R_5$ represents a hydrogen atom, a halogen atom, an alkyl group having from 1 to 4 carbon atoms, an aryl group, or an alkoxy group, and the number of $R_5$ may be 1 or more, while n represents a positive integer. n is preferably 0 to 10 and more preferably 0 to 6.

In general formula (8), $R_6$ and $R_7$ each represents a hydrogen atom, an alkyl group or an aryl group and $R_6$ and $R_7$ may combine with each other to form a ring. $R_8$ and $R_9$ each represents a hydrogen atom, a halogen atom, an alkyl group, an aryl group, or an alkoxy group, and the number of $R_7$ or $R_8$ may be 1 or more.

The recurring unit (8) is preferable among the recurring unit represented by general formulae (1) to (8).

Example of the organic group comprising a fluorine includes an alkyl or aryl group substituted by one or more fluorine atoms.

Example of the organic group comprising a silicon atom includes those represented by the formula;

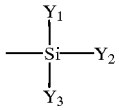

wherein Y1, Y2, and Y3 each represents an alkyl group, an aryl group or $—SiY_{11}Y_{21}Y_{31}$, wherein each of $Y_{11}$, $Y_{21}$ and $Y_{31}$ is an alkyl or aryl group.

In a production method of a photoreceptor described above, the electrophotographic photoreceptor is produced by coating composition comprising a resin, before crosslinking, and an isocyanate compound having two functional groups or more per molecule is coated employing a circular flow amount control type coating device.

DETAILED DESCRIPTION OF THE INVENTION

Figure 1:
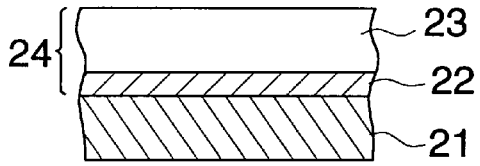
FIG. 1 is a sectional view showing a layer constitution of an electrophotographic photoreceptor.

The mechanical strength of a resin comprising a substituent subjected to crosslinking such as a hydroxyl group, an amino group, etc. can be enhanced employing a crosslinking agent having at least two groups such as an isocyanate group or an epoxy group, etc. However, cleaning properties and adhesion of paper dust cannot be improved only by the mechanical strength, and the surface of the photoreceptor is required to exhibit water repellency. Furthermore, in order to exhibit high electrophotographic speed, it is required to dissolve a charge transport material such as a triethanolamine derivative at high concentration.

The crosslinked resins are preferably those having characteristics the residual methylenechloride 5 wt % or more, preferably 15 wt % or more. The residual methylenechloride means that the amount of the residual methylenechloride by weight after refluxing with heating the mixture of the crosslinked resin and methylenechloride.

In the present invention, in order to meet these requirements, the water repellency is provided by partially introducing an organic group comprising a fluorine or silicon atom, and further, in order to improve the compatibility between a charge transport material and a resin, an aromatic portion is incorporated.

In the photoreceptor employing this resin, neither toner adhesion nor paper dust adhesion due to incomplete cleaning was observed, and it was found that these problems had been solved.

As the physical properties of the resin, a water contact angle was measured. It was found that the resin exhibits the large contact angle. The contact angle herein was measured as the water contact angle by a liquid drop method employing a contact angle meter CA-DT-A Type (manufactured by Kyowa Kaimen Kagaku Co).

Furthermore, the surface of a preferred photoreceptor, which was abraded by a thickness of 0.01 to 5 $\mu$m from the initial uppermost surface was found to exhibit a constant water contact angle of 90 degrees or more.

In order to evaluate this abrasion, any method may be employed to abrade a photoreceptor surface and may result in the same results. The surface was herein abraded by 1,000 revolutions at a rotation speed of 70 rpm under a load of 500 g at ambient conditions of a temperature of 20° C. and a humidity employing a Teber Abrasion Tester (manufactured by Toyo Seiki Co.).

The core of the invention is in the binder, which is prepared by crosslinking and hardening, employing a crosslinking agent comprising not less than 2 functional groups per molecule, a modified resin prepared by partially substituting a resin preferably comprising, in the molecule, an aromatic constituent and a hydroxyl or amino group with a functional group partially comprising a silicone or fluorine atom, or a resin prepared by copolymerizing monomers comprising a silicone or fluorine atom with monomers comprising a hydroxyl or amino group.

The resins are those which are preferably in the state prior to crosslinking and comprise at least one of a structural unit represented by the above-mentioned general formulas (1) through (8), as a partial structure.

In general formula (1), $R_1$ and $R_2$ each represents an hydrogen atom or an aryl group.

In general formulas (1) through (8), X represents a hydrogen atom, an alkyl group which combines directly or indirectly via a carbonyl group, an aryl group, and an organic group comprising a fluorine or silicon atom, and the molecular weight is preferably not more than 700.

Preferable examples of the organic group comprising a fluorine or silicon atom is described below.

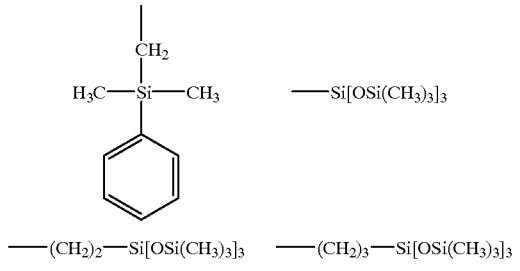

-continued

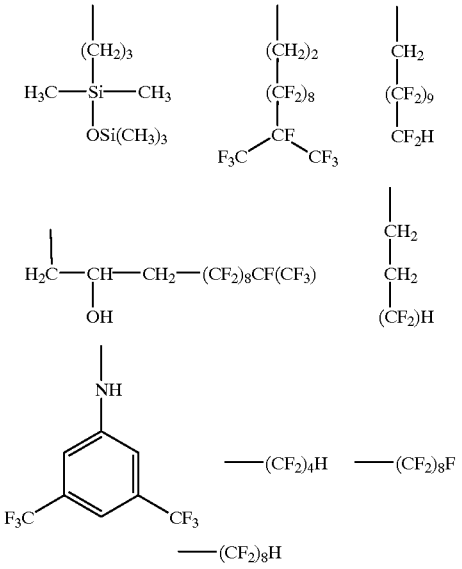

In general formulas (2) through (7), $R_3$ represents a hydrogen atom or an alkyl group having from 1 to 3 carbon atoms; $R_4$ represents a hydrogen atom, an alkyl group or an aryl group; $R_5$ represents a hydrogen atom, a halogen atom, an alkyl group having from 1 to 4 carbon atoms, an aryl group, or an alkoxy group, and the number of substituents may be 1 or more.

n represents a positive integer.

In general formula (8), $R_6$ and $R_7$ each represents a hydrogen atom or an aryl group and may combine with each other to form a ring. $R_8$ and $R_9$ each represents a hydrogen atom, a halogen atom, an alkyl group, an aryl group or an alkoxy group, and the number of substituents may be 1 or more.

Further, in general formula (1), at least one of $R_1$, $R_2$, or X is preferably an aryl group, and the monomer having a structural unit of general formulas (1) through (7) may copolymerize individually or with another vinyl compound, and particularly, in order to improve the compatibility with the charge transport material, the monomer represented by general formulas (2) through (5) is preferred to copolymerize with a vinyl compound, comprising an aromatic constituent.

The vinyl compounds comprising the aromatic constituent include, for example, styrene, methylstyrene, chlorostyrene, hydroxystyrene, vinylpyridine, vinylcarbazole, etc.

Of resins those having a structural unit represented by general formula (8) are most preferred which are prepared by partially modifying a resin obtained from a bisphenol compound and epichlorohydrin with a silicone- or fluorine-containing compound, and exhibit great compatibility with the charge transport material.

The resins are preferably those which comprise, in the state before crosslinking, the structural unit represented by the above-mentioned general formulas (1) through (8), at least, as a partial structure. More specifically, the resins are those which, in the state before crosslinking, simultaneously comprise at least a structural unit in which X in the above-mentioned general formulas (1) through (8) is a structural unit showing hydrogen atom and a structural unit in which X is an organic group having a fluorine or silicon atom.

The specific examples are shown below.
(A-1)
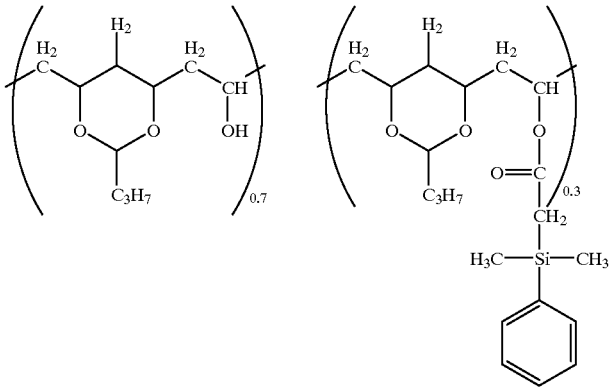
(A-2)
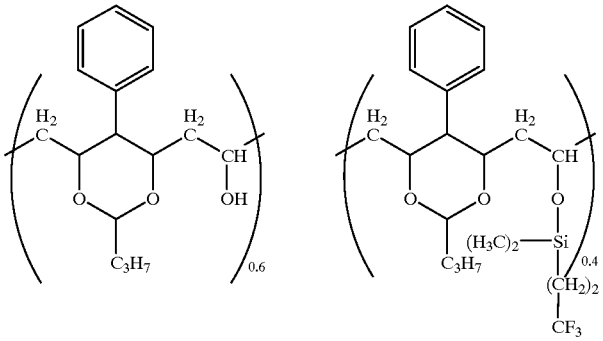
(A-3)
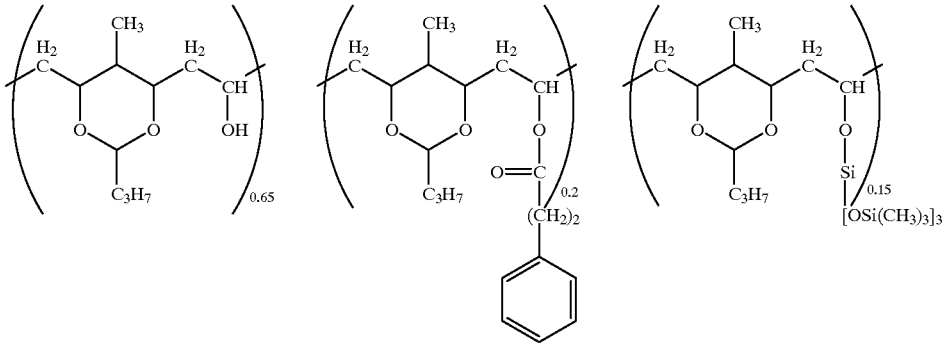
(A-4)
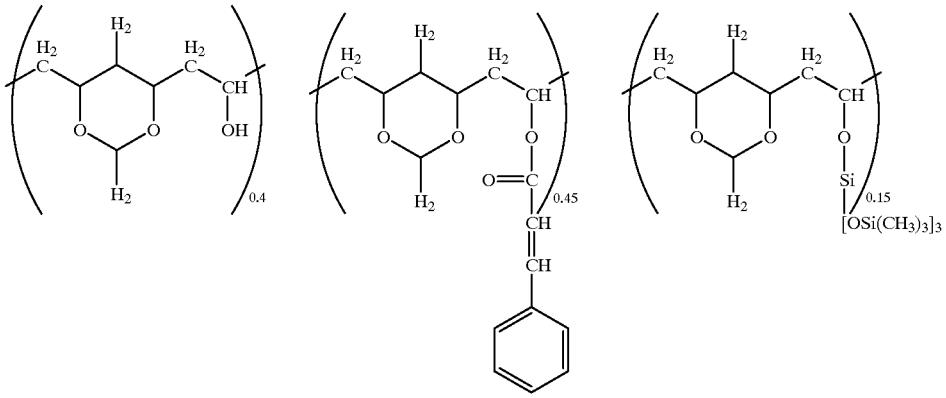

-continued
(A-5)
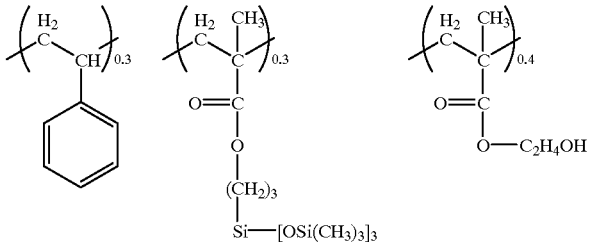
(A-6)
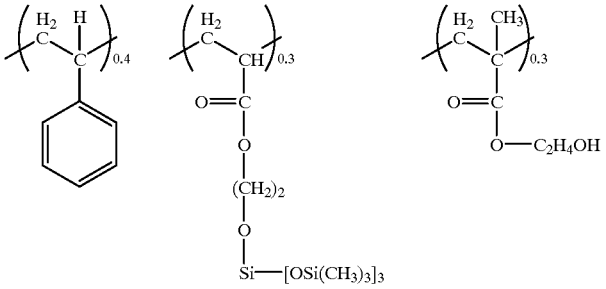
(A-7)
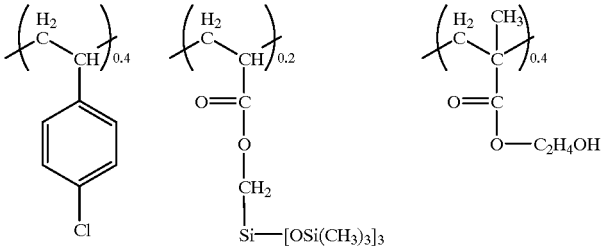
(A-8)
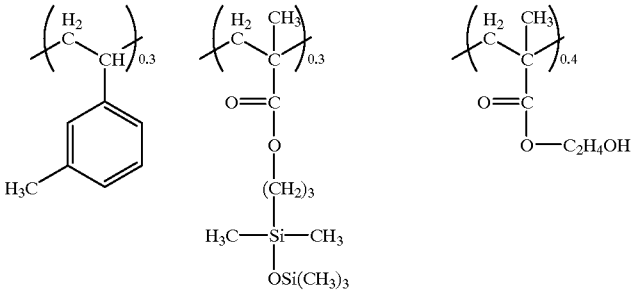
(A-9)
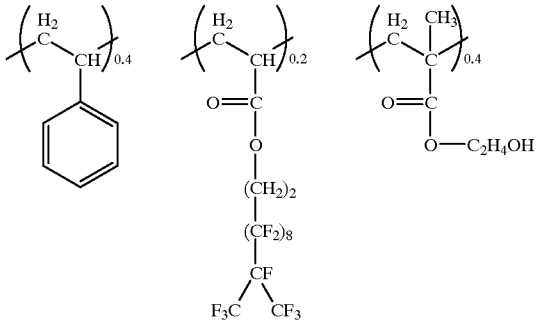

-continued
(A-10)
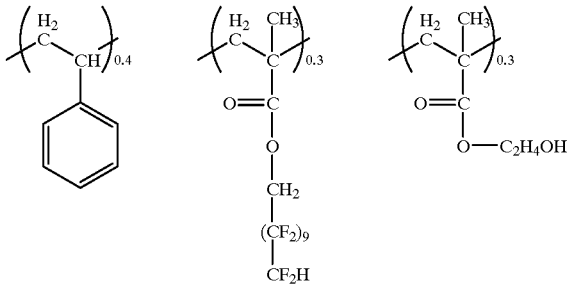
(A-11)
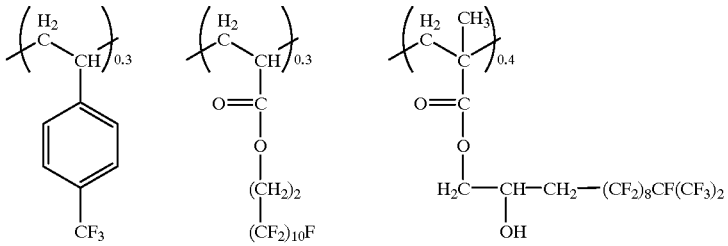
(A-12)
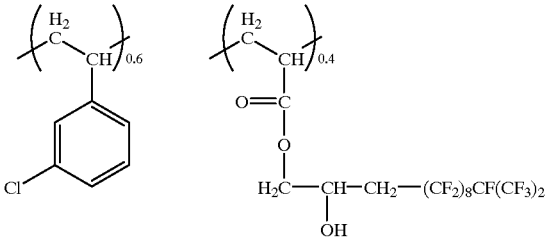
(A-13)
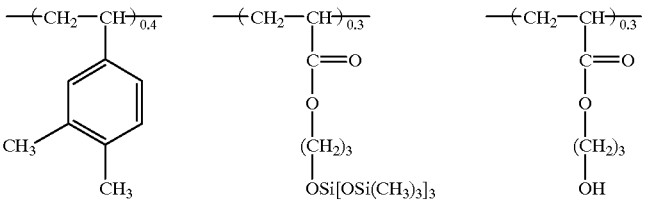
(A-14)
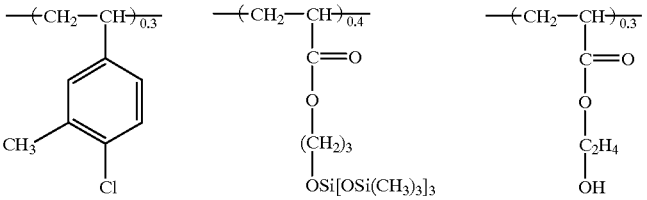
(A-15)
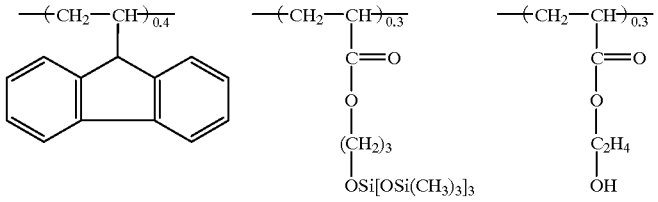

-continued
(A-16)
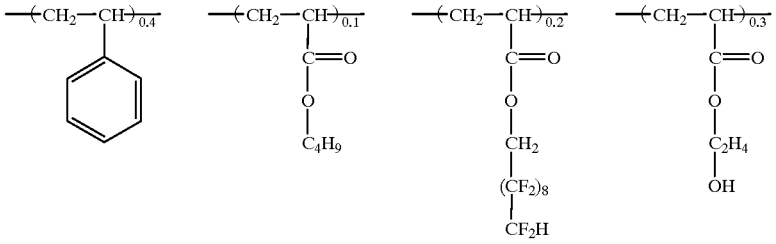
(A-17)
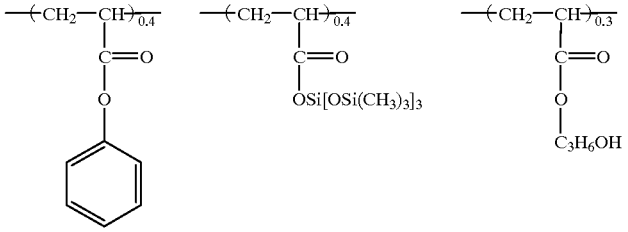
(A-18)
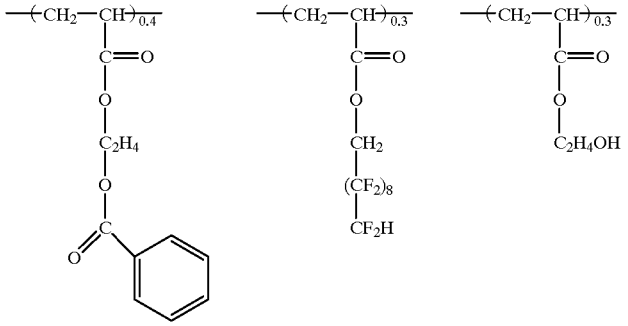
(A-19)
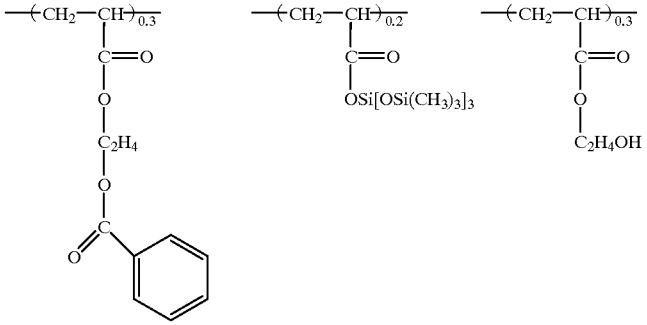
(A-20)
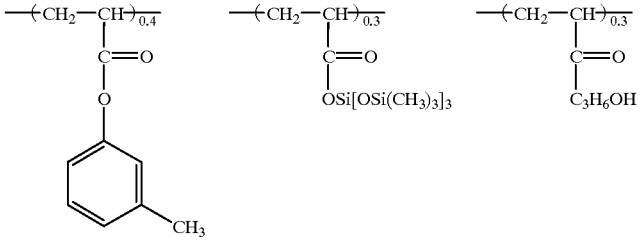

-continued
(A-21)
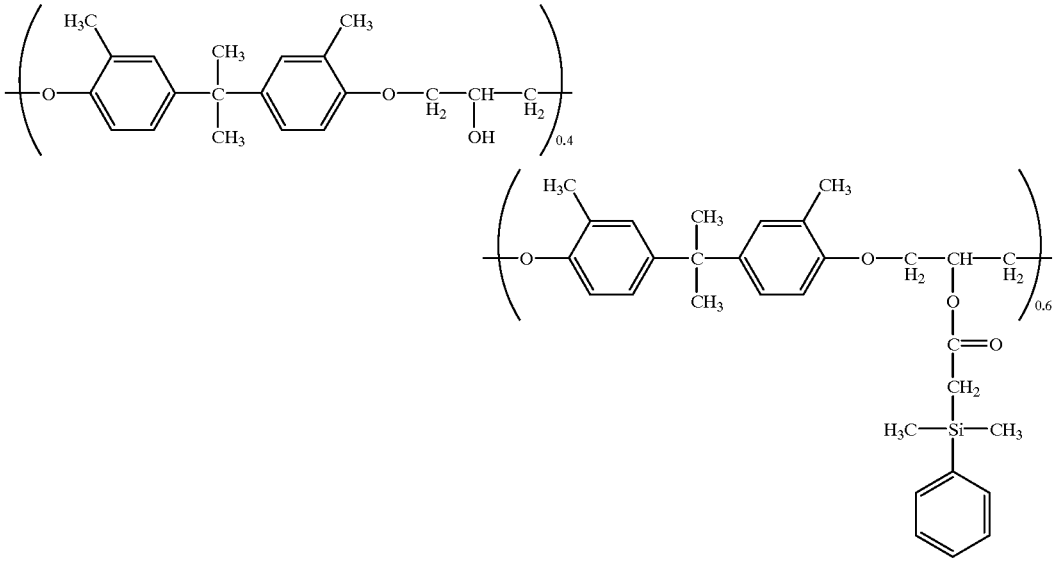
(A-22)
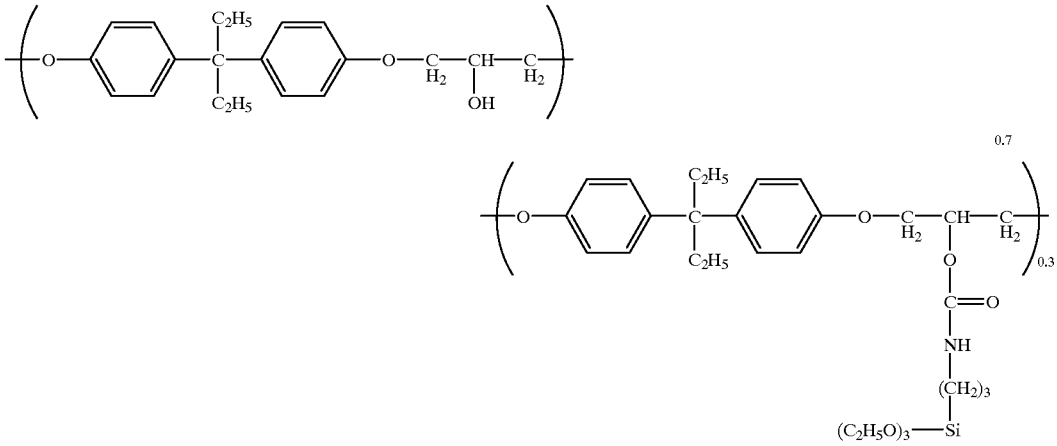
(A-23)
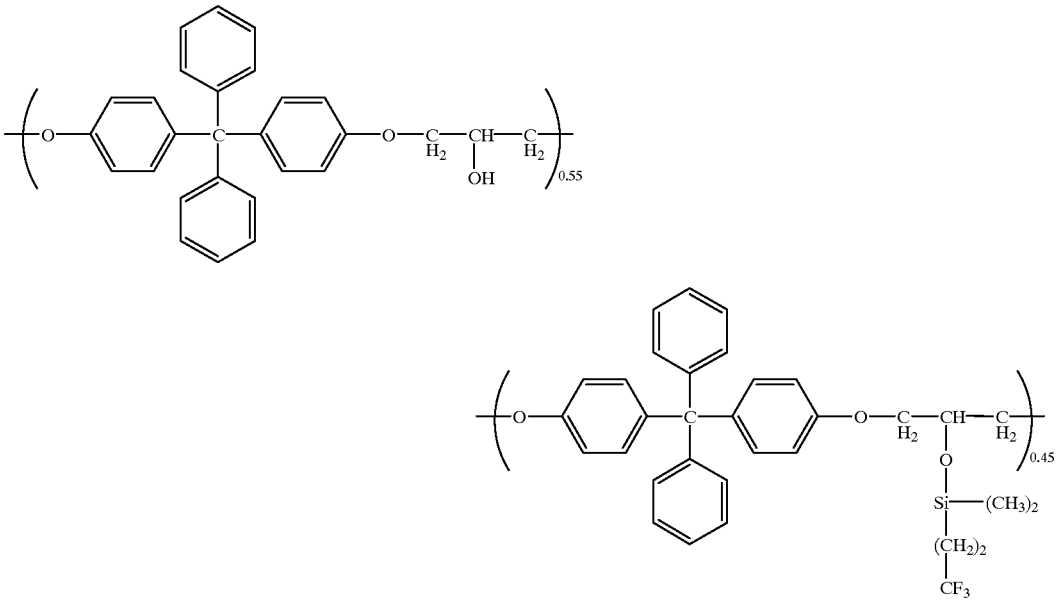

-continued
(A-24)
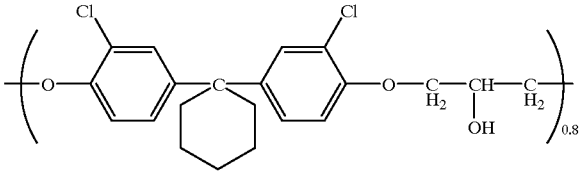
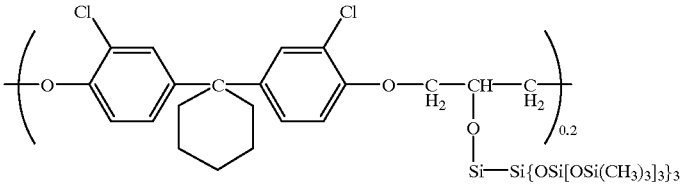
(A-25)
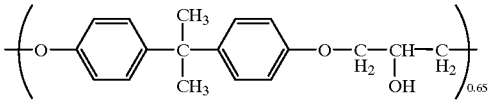
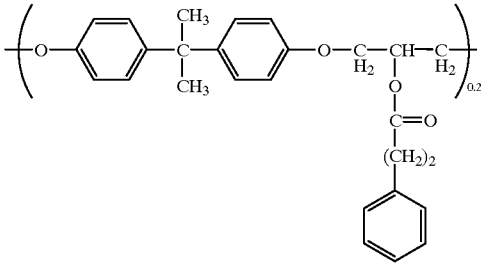
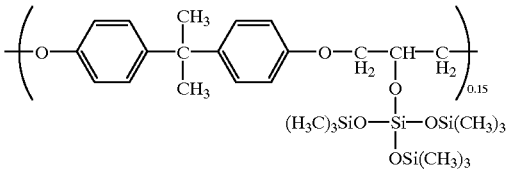
(A-26)
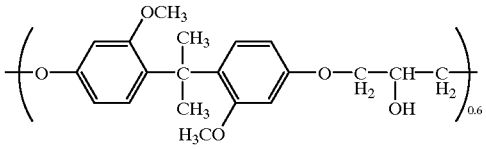
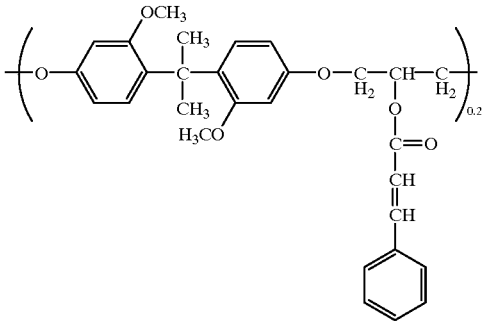
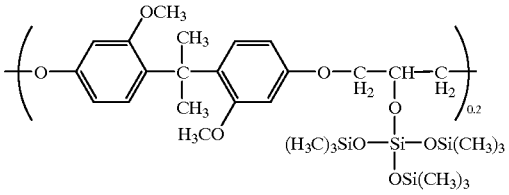

-continued
(A-27)
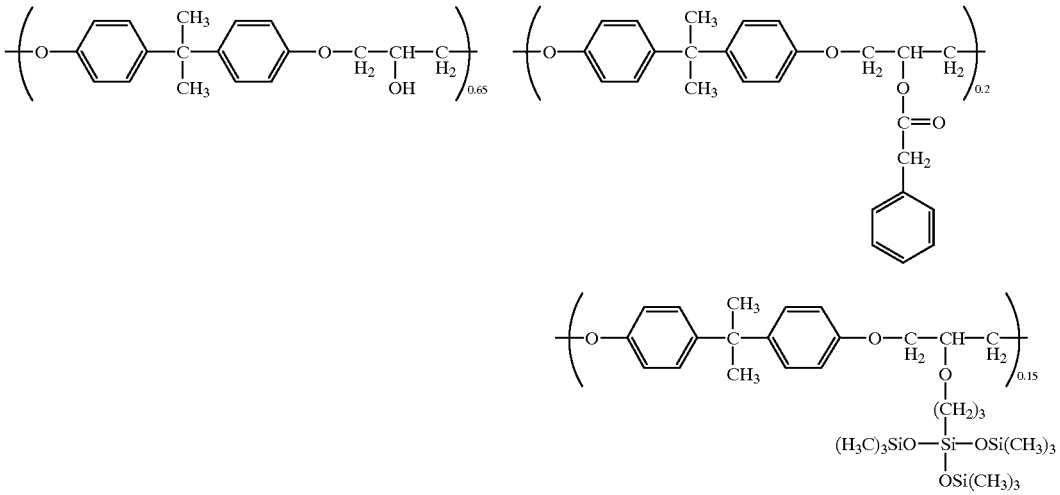
(A-28)
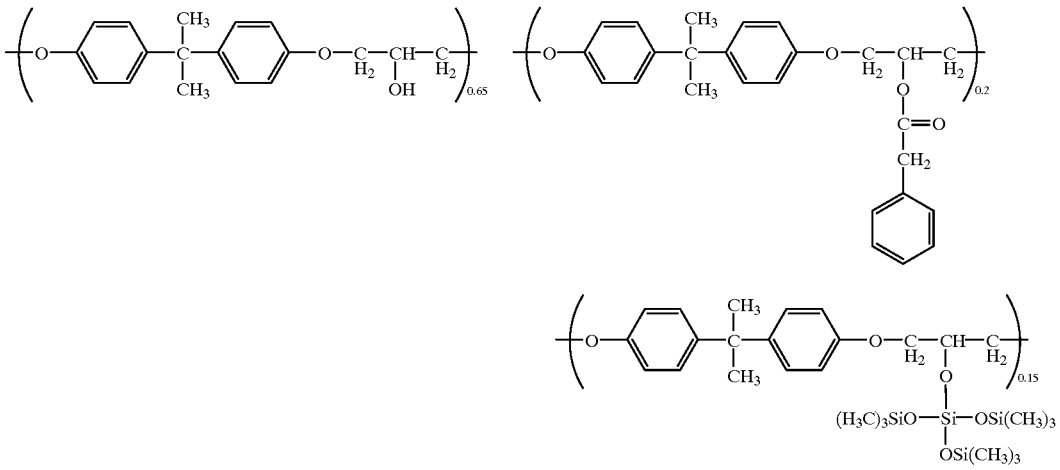
(A-29)
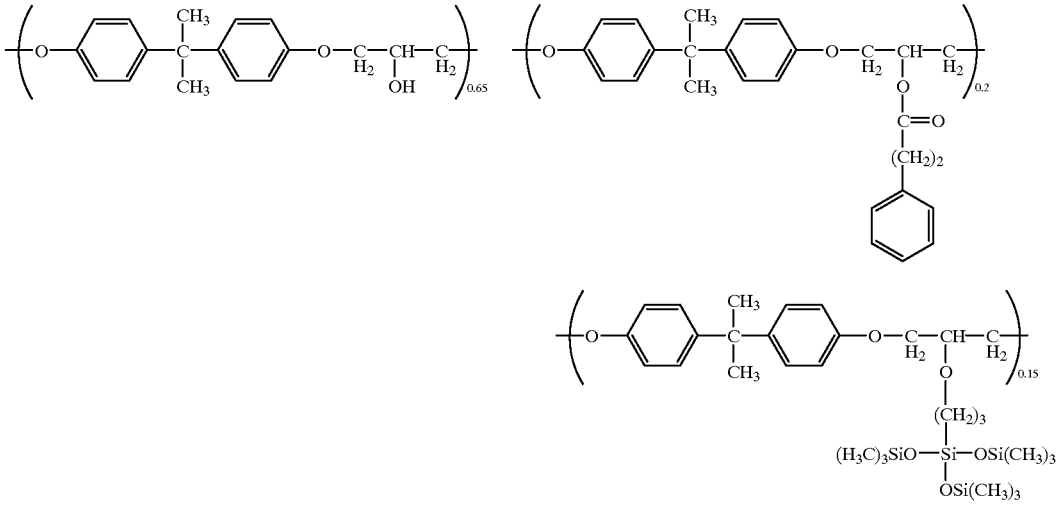

-continued
(A-30)
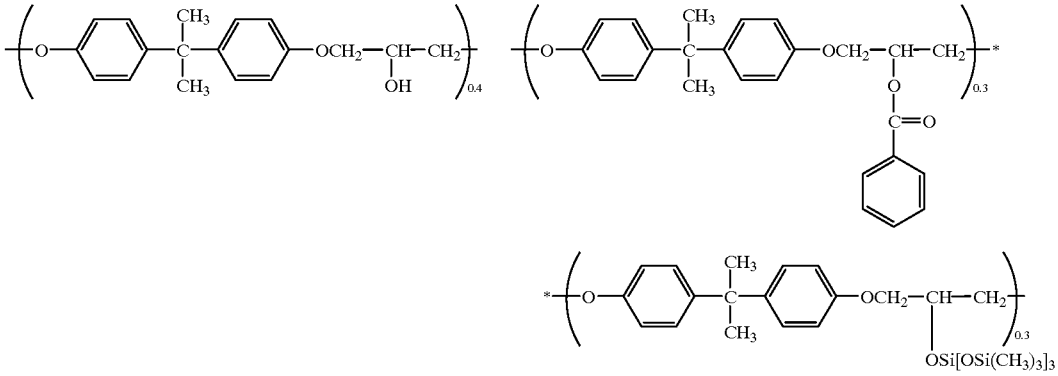
(A-31)
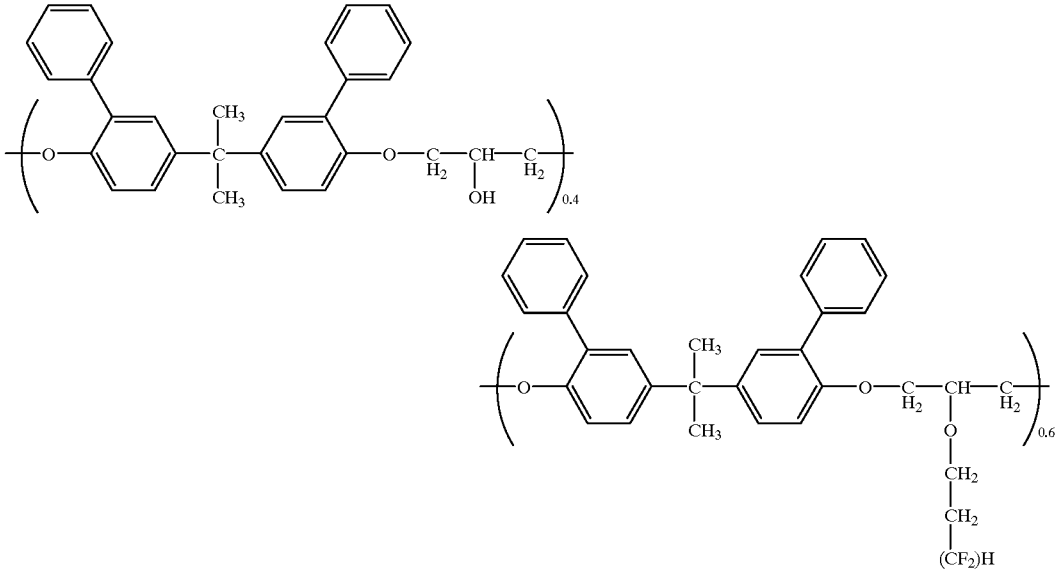
(A-32)
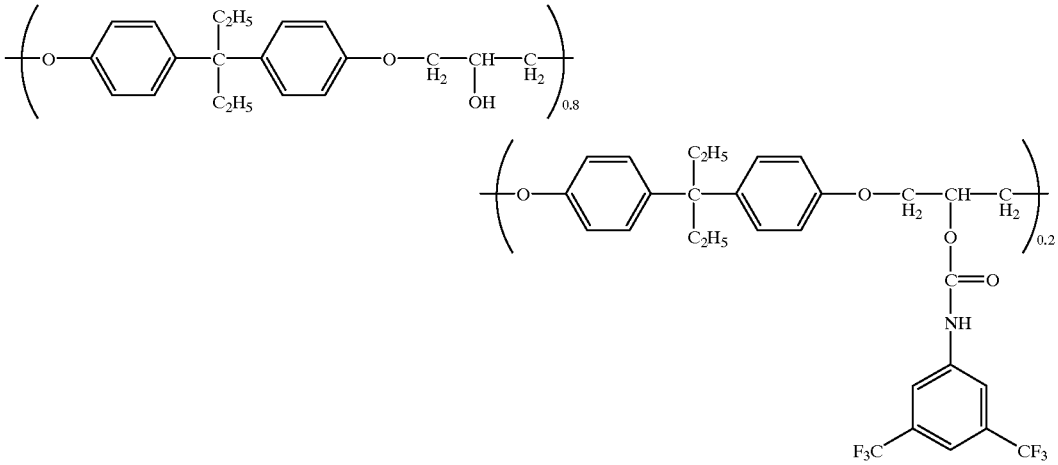
(A-33)
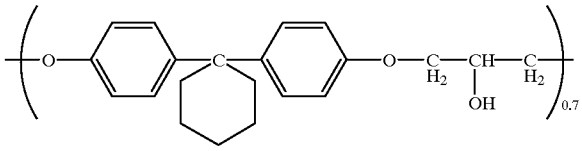

-continued
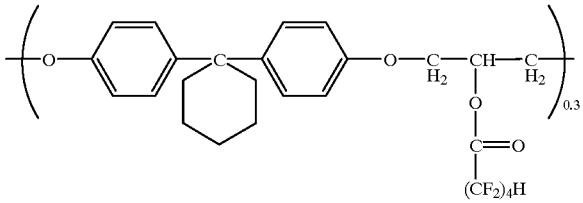
(A-34)
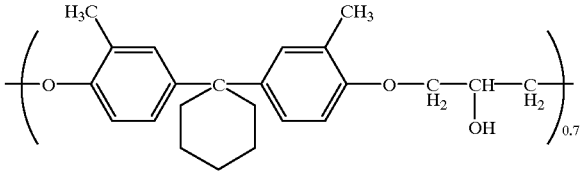
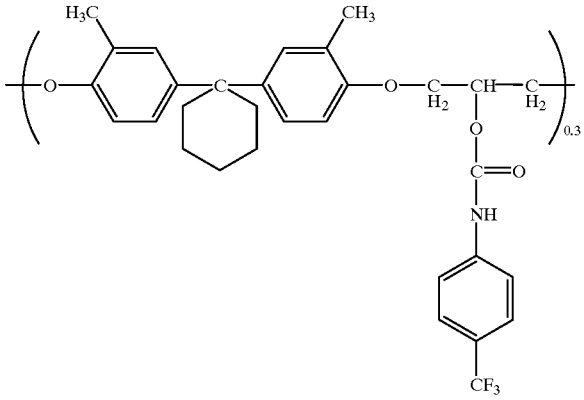
(A-35)
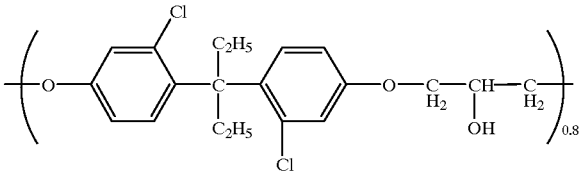
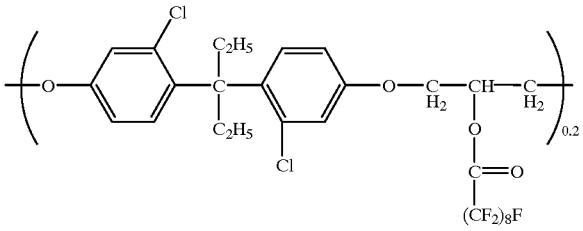
(A-36)
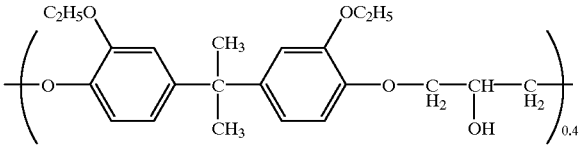

-continued
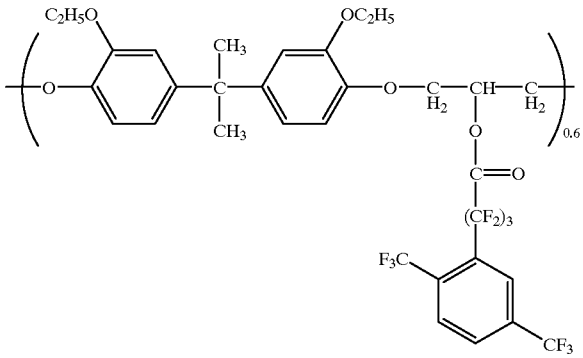
(A-37)
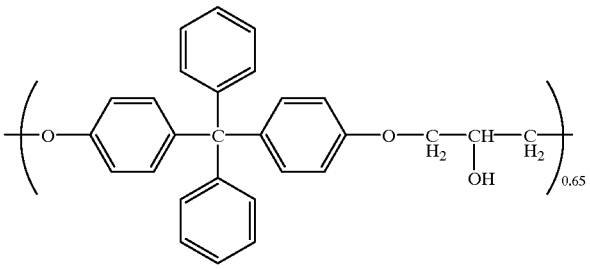
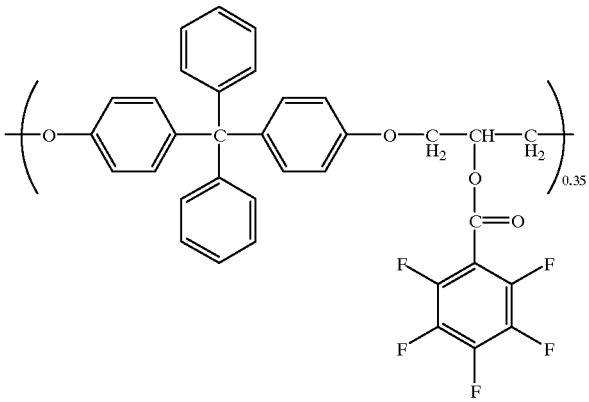
(A-38)
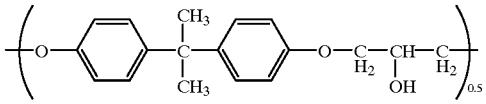
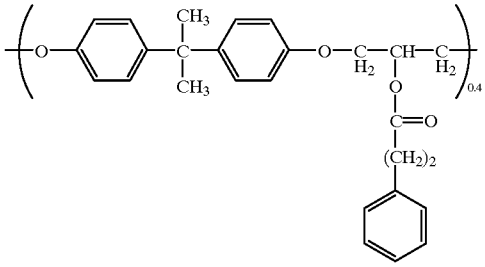
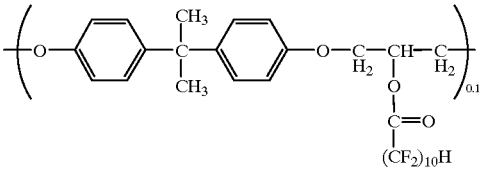

-continued (A-39)

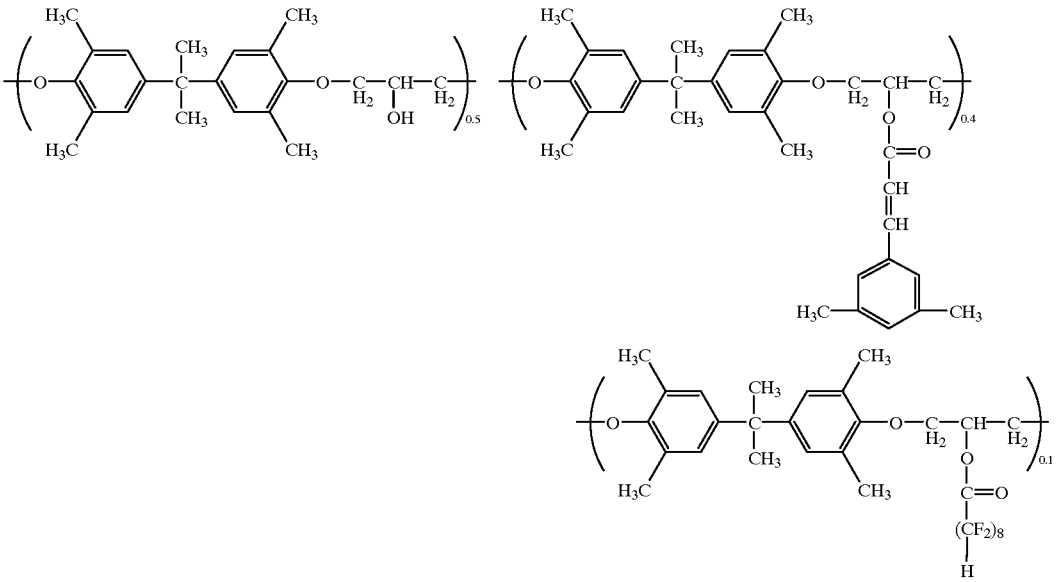

As a method to crosslink a resin employed in the photoreceptor, either a thermal linking method or a light linking method may be employed. Generally, however, linking is carried out employing thermal linking.

Crosslinking agents include, for example, polyisocyanate compounds comprising not less than 2 functional groups per molecule, isocyanate compounds such as block isocyanates prepared by a partial reaction with a compound having a group which can react with a isocyanate group, urea resins, melamine resins, phenol resins, epoxy resins, etc. In the present invention, particularly, are preferred isocyanate compounds comprising a functional group having two functions or more such as, for example, polyisocyanate compounds, block isocyanates prepared by a partial reaction with a compound having a group which can react with an isocyanate group, etc. The number of functional groups per molecule of a crosslinking agent is not less than 2 necessary for crosslinking, and the upper limit depends on the possibility of the synthesis of a crosslinking agent and the cost.

Specific examples of isocyanate compounds having not less than 2 functional groups per molecule are shown below.

(B-1)

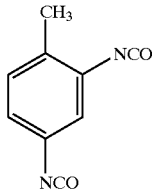

(B-2)

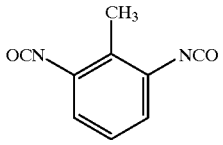

-continued (B-3)

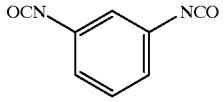

(B-4)

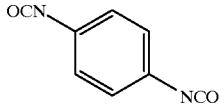

(B-5)

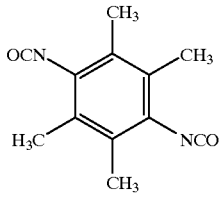

(B-6)

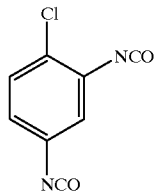

(B-7)

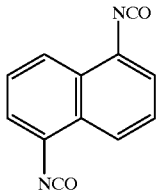

-continued
(B-8)
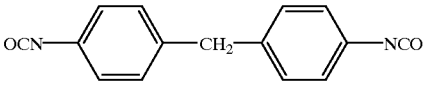
(B-9)
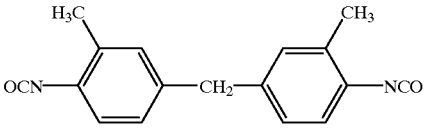
(B-10)
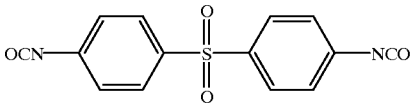
(B-11)
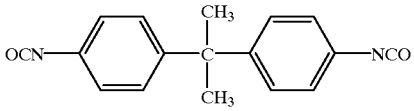
(B-12)
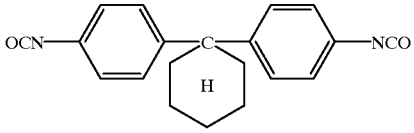
(B-13)
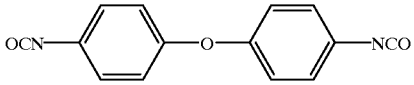
(B-14)
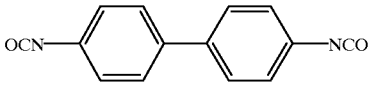
(B-15)
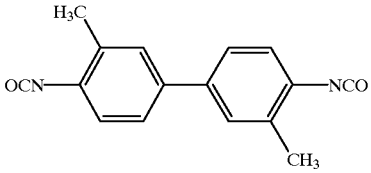
(B-16)
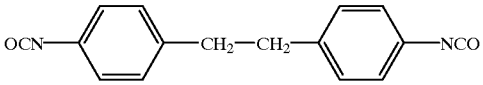
(B-17)
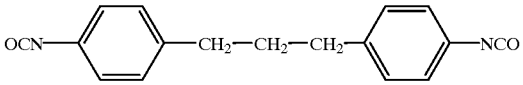
(B-18)
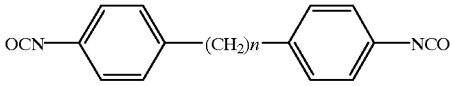
$n \geqq 4$
-continued
(B-19)
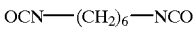
(B-20)
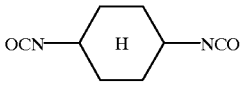
(B-21)
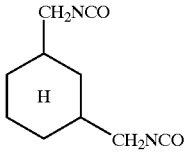
(B-22)
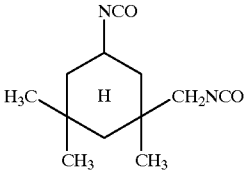
(B-23)
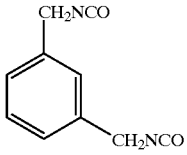
(B-24)
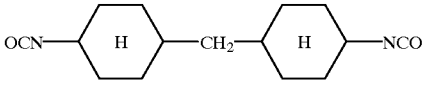
(B-25)
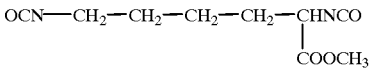
(B-26)
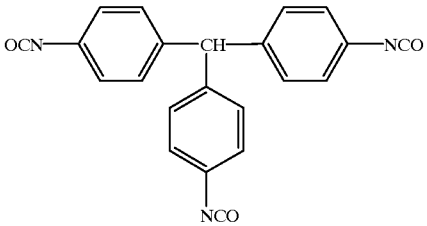
(B-27)
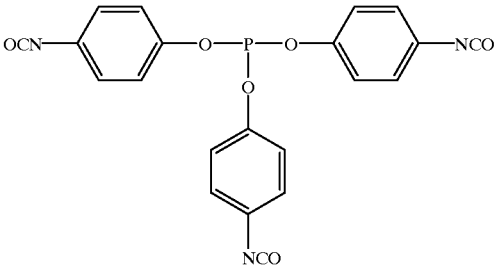

-continued (B-28)

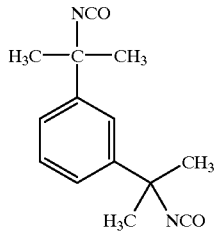

(B-29)

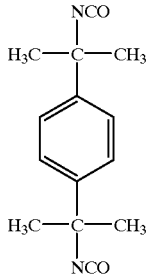

(B-30)

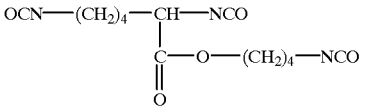

(B-31)

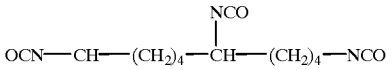

(B-32)

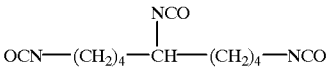

(B-33)

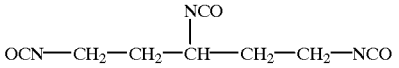

(B-34)

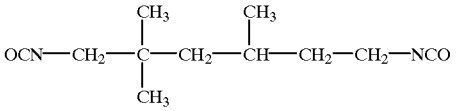

(B-35)

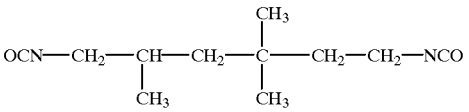

(B-36)

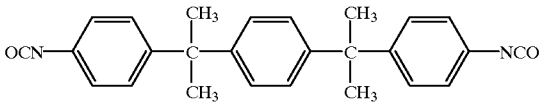

(B-37)

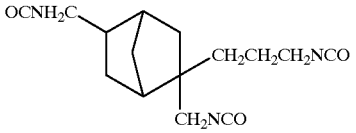

-continued (B-38)

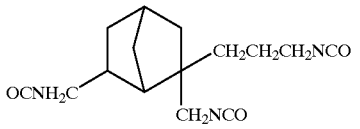

(B-39)

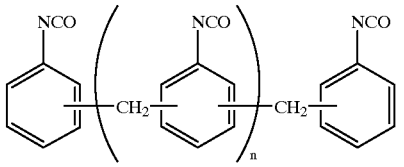

$n \geqq 1$

The ratio of a crosslinking agent to a resin employed for the photoreceptor is determined by the number of residual OH groups. Generally, because one reaction spot corresponds to one residual OH group, the ratio is preferably between 10 and 200 mole percent of the resin. When the crosslinking agent is too small in amount, a portion which has not been subjected to crosslinking remains and insufficient mechanical strength is obtained. On the contrary, when the crosslinking agent exists in excessive amounts, electrical properties are deteriorated.

A layer in which the resin is subjected to crosslinking can be employed in any layer of the photoreceptor. However, because the resin exhibits excellent mechanical strength, the layer is employed at least as the uppermost layer.

Charge generating materials employed in the electrophotographic photoreceptor include, for example, phthalocyanine compounds such as, at first, specifically, A-type, B-type, Y-type, and other type crystallized titanylphthalocyanine, mixed crystals of titanylphthalocyanine with another phthalocyanine, further, X-, τ-type, and other type metal-free phthalocyanines, various metal phthalocyanines represented by copper phthalocyanine, etc.

Charge generating materials include, for example, porphyrin derivatives, azo compounds, perylene dyes such as imidazoleperylene and bisimidoperylene, polycyclic quinone dyes such as anthanthrone, anthraquinone, etc., perynone dyes, eutectic complexes of perylium compounds and pyrylium compounds, azulenium compounds, squarium compounds, etc.

As charge transport materials employed in the electrophotographic photoreceptor, various compounds can be employed. Representative examples include compounds comprising nitrogen-containing heterocyclic ring nucleus and condensed ring nucleus thereof represented by oxazole, oxadiazole, thiazole, thiadiazole, imidazole, etc., polyarylalkane-type compounds, hydrazone series compounds, pyrazoline series compounds, triarylamine series compounds, styryl series compounds, poly(bis)styryl series compounds, styryltriphenylamine series compounds, β-phenylstyryltriphenylamine series compounds, butadiene series compounds, hexatriene compounds, carbazole series compounds, condensed polycyclic series compounds, etc.

As specific examples of the charge transport material, can be cited those which are described in, for example, Japanese Patent Publication Open to Public Inspection No. 61-107356.

Representative compounds are shown below.
(C-1)
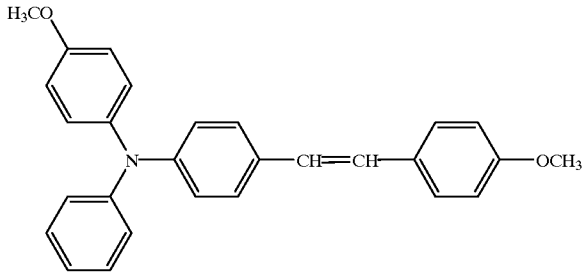
(C-2)
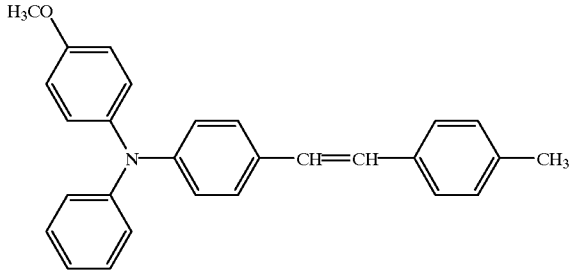
(C-3)
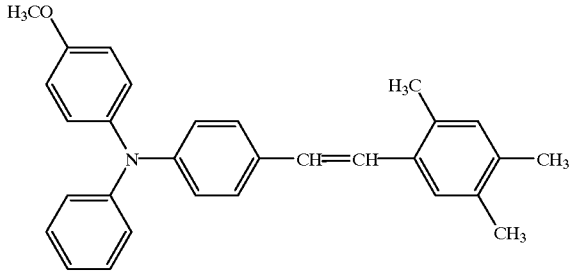
(C-4)
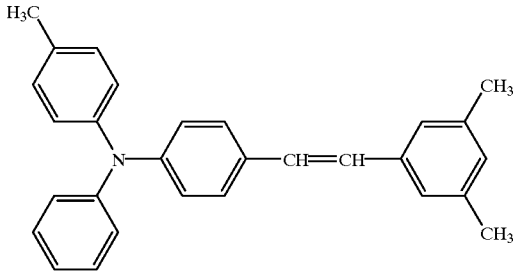
(C-5)
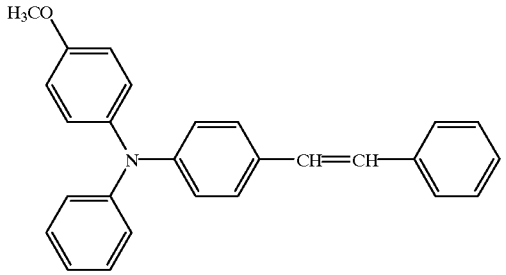

-continued
(C-6)
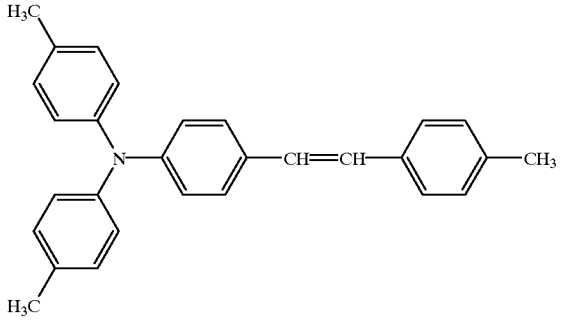
(C-7)
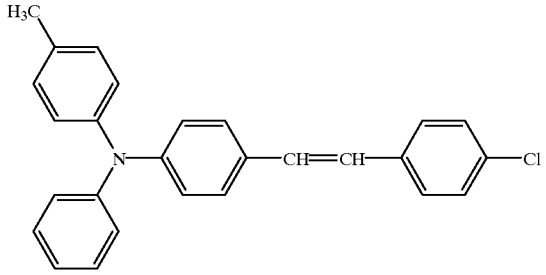
(C-8)
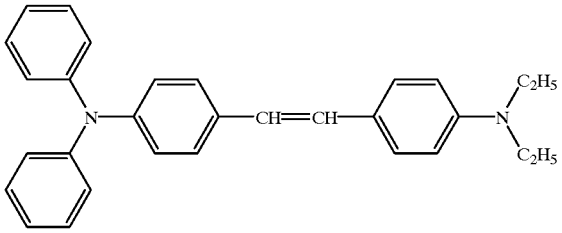
(C-9)
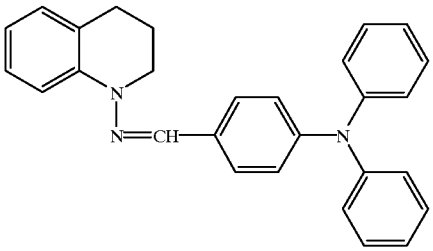
(C-10)
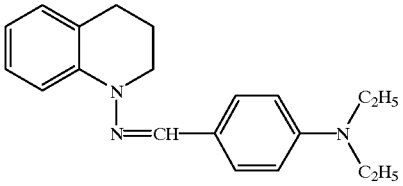
(C-11)
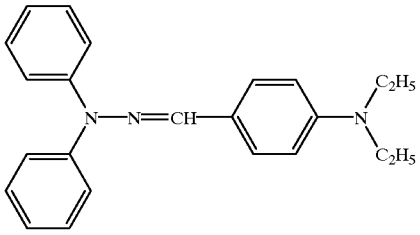

-continued
(C-12)
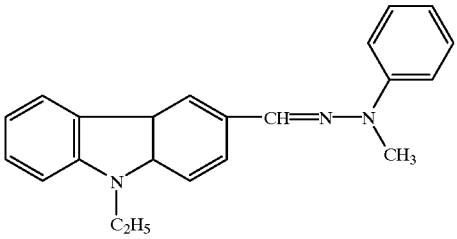
(C-13)
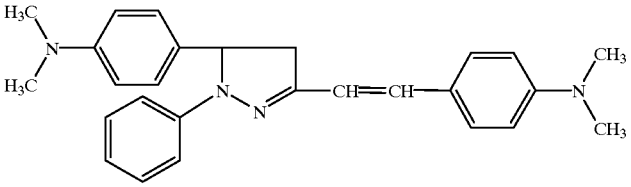
(C-14)
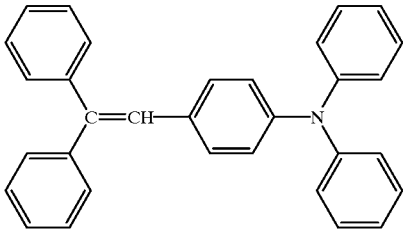
(C-15)
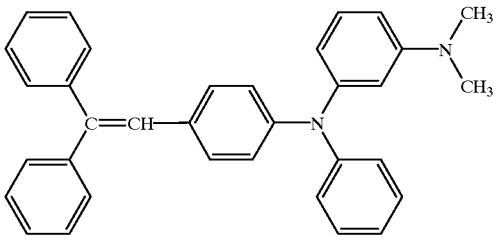
(C-16)
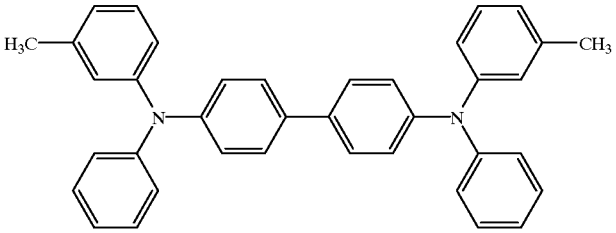
(C-17)
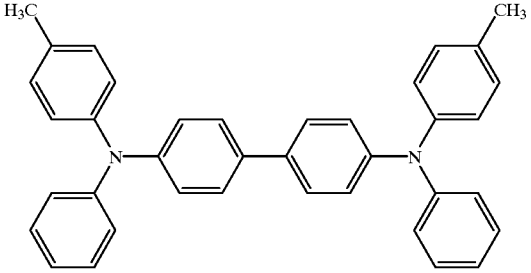

-continued
(C-18)
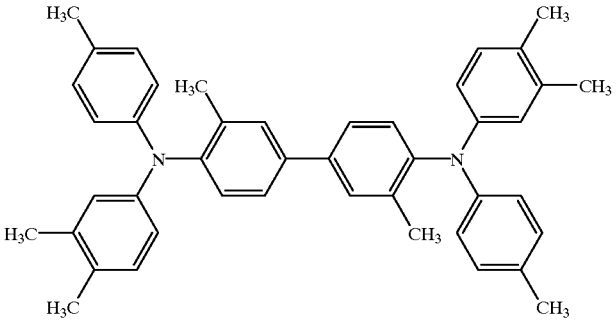
(C-19)
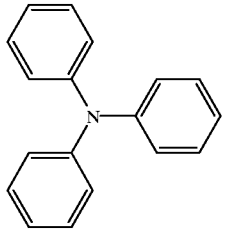
(C-20)
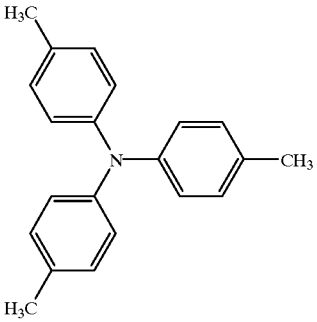
(C-21)
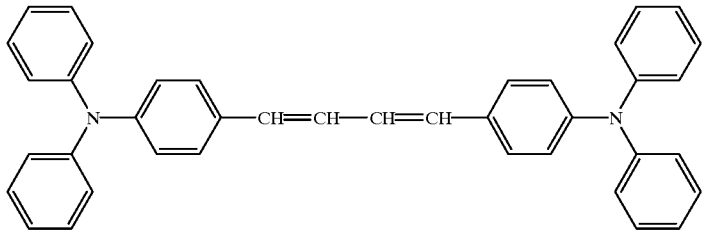
(C-22)
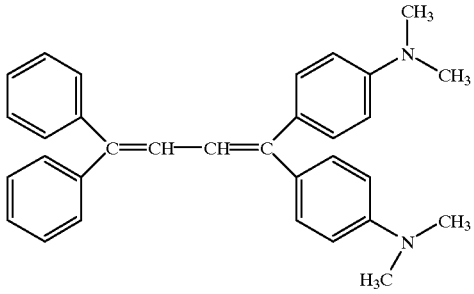

-continued
(C-23)
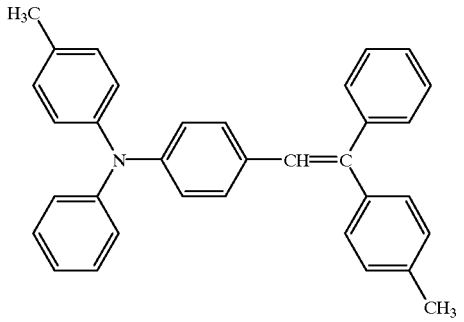
(C-24)
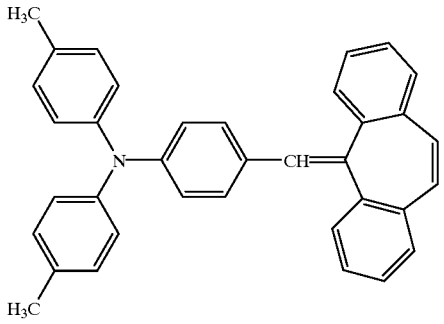
(C-25)
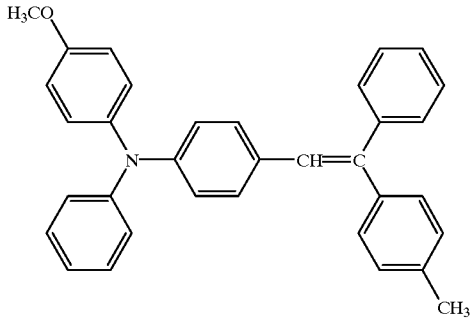
(C-26)
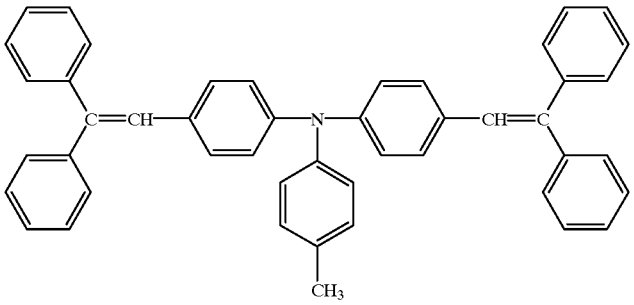

-continued (C-27)

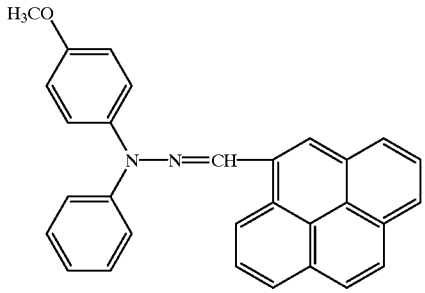

(C-28)

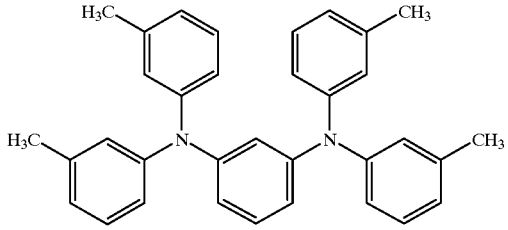

(C-29)

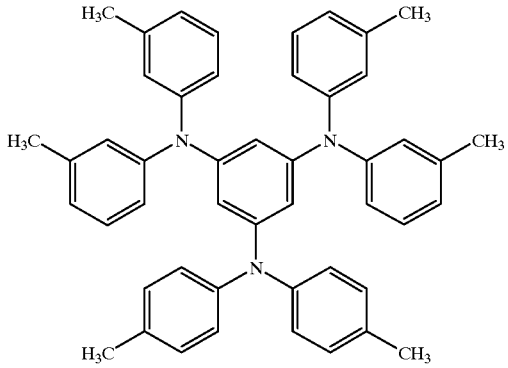

(C-30)

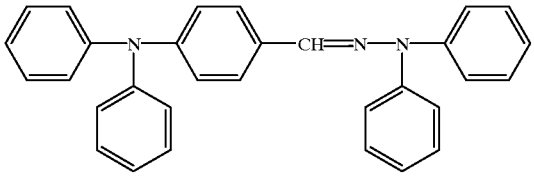

(C-31)

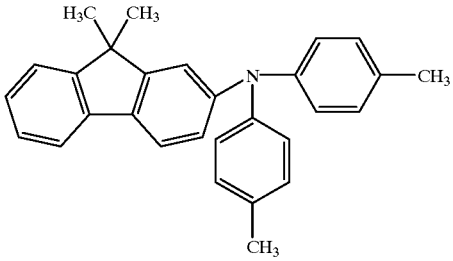

Regarding the constitution of the photoreceptor, various configurations are known. FIG. 1 is a view explaining the layer constitution of a photoreceptor and a single layer-type or multilayer-type function separating-type photoreceptor is preferred. Generally, the constitution is such as shown in FIGS. 1(1) to 1(6).

The layer constitution shown in FIG. 1(1) is that on a conductive support 21, a charge generating layer 22 is formed and on the resulting coating, a charge transport layer 23 is coated to form a photosensitive layer 24. The layer constitution shown in FIG. 1(2) is that on a conductive layer 21, a charge transport layer 23 is formed and on the resulting coating, a charge generating layer 22 is coated to form a photosensitive layer 24'. The layer constitution shown in FIG. 1(3) is that an interlayer 25 is provided between a photosensitive layer 24 and a conductive support 21. The layer constitution shown in FIG. 1(4) is that an interlayer 25 is provided between a photosensitive layer 24' in the layer constitution shown in FIG. 1(2) and a conductive support 21. The interlayer 25 shown in above-mentioned FIGS. 1(3) and 1(4) is to prevent free-electron injection from the conductive support 21. The layer constitution shown in FIG. 1(5) is that a photosensitive layer 24", comprising a charge transport material 27 which is combined with a charge generating material 26 is formed. The layer constitution shown in FIG. 1(6) is that an interlayer 25 is provided between the above-mentioned photosensitive layer 24" and a conductive support 21. In the photoreceptor, functions can be separated by coating two charge transport layers or more composed of different compositions, and furthermore, a protective layer can be provided in the uppermost layer.

In the present invention, when a photosensitive layer is formed on the conductive support 21, a method is advantageously employed wherein a solution is coated in which a charge transport material is dissolved individually or in combination with other resin or additives.

On the other hand, generally, charge transport materials exhibit low solubility to solvents. Therefore, a method is advantageously employed in which a composition prepared by finely dispersing a charge transfer material into a suitable dispersion medium employing a ball mill, a sand mill, etc. is coated. In this case, generally, a resin and additives are added to the dispersion and employed.

As halogen-free series solvents or dispersion media employed to form a photoreceptor, those which are optional can be widely employed, and include, for example, acetone, methyl ethyl ketone, methyl isopropyl ketone, methyl isobutyl ketone, cyclohexanone, 4-methoxy-4-methyl-2-pentanone, tetrahydrofuran, dioxane, ethyl acetate, n-butyl acetate, t-butyl acetate, methyl cellosolve, ethyl cellosolve, butyl cellosolve, ethylene glycol dimethyl ether, toluene, xylene, acetophenone, methanol, ethanol, propanol, butanol, etc.

Halogen series solvents conventionally employed, for example, methylene chloride, 1,2-dichloroethane, etc. can also be employed.

For forming a charge generating layer or a charge transport layer, the other resins may be employed in combination. As resins for the combination, any available resins can be optionally chosen. However, preferred resins composed of high molecular polymers exhibiting film forming property are, such polymers as, for example, the following mentioned below.

Bisphenol A-type polycarbonate resins, bisphenol Z-type polycarbonate resins, or modified-polycarbonate resins modified with epoxy, silicone or acryl, acryl resins, methacryl resins, polyvinyl chloride resins, polyvinylidene chloride resins, polystyrene resins, styrene-butadiene copolymer resins, polyvinyl acetate resins, polyvinylformal resins, polyvinyl butyral resins, polyvinyl acetal resins, polyvinylcarbazole resins, styrene-alkyd copolymer resins, silicone resins, silicone-alkyd copolymer resins, silicone-butyral copolymer resins, polyester resins, polyurethane resins, polyamide resins, epoxy resins, phenol resins, vinylidene chloride-acrylonitrile copolymer resins, vinyl chloride-vinyl acetate copolymer resins, vinyl chloride-vinyl acetate-maleic acid anhydride copolymer resins, etc.

The ratio of the charge transport material to the resin is preferably between 10 and 600 weight percent, and more preferably between 50 and 400 weight percent. The ratio of the charge transport material to the resin is preferably between 10 and 500 weight percent.

The thickness of a charge generating layer is between 0.01 and 20 $\mu$m, and preferably between 0.05 and 5 $\mu$m. The thickness of a charge transport layer is between 1 and 100 $\mu$m, and preferably between 5 and 30 $\mu$m.

In order to improve sensitivity, to decrease residual potential, or to minimize fatigue during repeated usage, electron accepting materials may be incorporated into the photoreceptor. Such electron accepting materials include, for example, succinic acid anhydride, maleic acid anhydride, dibromosuccinic acid anhydride, phthalic acid anhydride, tetrachlorophthalic acid anhydride, tetrabromophthalic acid anhydride, 3-nitrophthalic acid anhydride, 4-nitrophthalic acid anhydride, pyromellitic acid anhydride, mellitic acid anhydride, tetracyaoethylene, tetracyanoquinodimethane, o-dinitrobenzene, m-dinitrobenzene, 1,3,5-trinitrobenzene, p-nitrobenzonitrile, picryl chloride, quinonechloroimide, chloranil, bromanil, dichlorodicyano-p-benzoquinone, anthraquinone, dinitroantharquinone, 9-fluorenylydenemalononitrile, polynitro-9-fluorenylydeinemalononitrile, picric acid, o-nitrobenzoic acid, p-nitrobenzoic acid, 3,5-dinitrobenzoic acid, pentafluorobenzoic acid, 5-nitrosalicylic acid, 3,5-dinitrosalycylic acid, phthalic acid, mellitic acid, and other such compounds having a large electron affinity.

The added ratio of an electron accepting material is preferably between 0.01 and 200 weight parts to 100 weight parts of the charge generating material and more preferably between 0.1 and 100 weight parts.

In order to improve storage quality, durability, and environmental dependency, degradation preventing agents such as antioxidants, light stabilizing agents, etc. may be incorporated into the photosensitive layer of the photoreceptor.

Compounds which are employed for such purposes include, for example, chromanol derivatives and etherified or esterified compounds thereof such as tocopherol, etc., polyalkane compounds, hydroquinone derivatives and mono- and di-etherified compounds thereof, benzophenone derivatives, benzotriazole derivatives, thioether compounds, phosphonic acid esters, phosphorous acid esters, phenylenediamine derivatives, phenol compounds, hindered-phenol compounds, straight chain amine compounds, cyclic amine compounds, hindered-amine compounds. Specific examples of particularly effective compounds include hindered-phenol compounds such as "IRGANOX 1010", "IRGANOX 565" (manufactured by Ciba-Geigy), "Sumilizer BHT", "Sumilizer MDP" (manufactured by Sumitomo Kagaku Kogyo Co.), etc., and hindered amine compounds such as "Sanol LS-2626", "Sanol LS-622LD" (manufactured by Sankyo Co.). The added ratio of the degradation preventing agent is preferably between 0.1 and 100 weight parts to 100 weight parts of the charge transport material and more preferably between 0.5 and 20 weight parts.

As the resins employed in the interlayer of the photoreceptor, those cited for the charge generating layer and charge transport layer can be employed. In addition to those, effectively employed are nylon resins; ethylene series resins such as ethylene-vinyl acetate copolymer resins, ethylene-vinyl acetate-maleic acid anhydride copolymer resins, ethylene-vinyl acetate-methacrylic acid copolymer resins, etc.; polyvinyl alcohol resins, cellulose derivatives, etc. Crosslinking-type resins are employed which utilize crosslinking action exhibited by functional groups containing compounds such as melamine, epoxy or isocyanate, etc. or coupling agents containing metal atoms such as Ti/Zr/Al.

As conductive supports, can be employed, in addition to metal plates and metal drums, those which are provided, on paper and various plastic substrates, a thin layer of conductive polymer, indium oxide, etc. or a thin layer of metal such as aluminum, palladium, etc. by the means of coating, evaporation, lamination, etc.

Conventionally, when an organic photoreceptor is formed employing a coating means, various coating methods such as a dip coating, a blade coating, a spin coating, a beam coating a spiral coating, etc. are employed. Of these, due to low cost and easy formation of a flat and smooth coating layer, the dip coating method is most widely employed in which a material to be coated is dipped in a tank filled with a plenty of a coating composition.

However, when the photoreceptor is prepared employing the dip coating method, during dipping at coating, the uppermost layer coated in advance is partly dissolved to cause a non-uniform surface. Due to that, the photoreceptor possibly causes image defects. Furthermore, even though non-uniform surface would have not been caused, components of the layer coated in advance would have been mixed little by little with the coating composition for the following layer. When the production is repeated, mixed components are accumulated to vary the coating composition. Particularly, the coating composition comprising an active hardener such as an isocyanate compound may react with mixing components and may be subjected to large adverse effect.

Of the photoreceptors of the present invention, those prepared by a circular flow amount control type coating device, particularly one type, a slide hopper type coating device causes no defects mentioned above and generates excellent images. These coating techniques are described in Japanese Patent Publication Open to Public Inspection No. 58-189061, 7-128023, 7-162021, etc.

The method is described below.

Figures 1, 2:
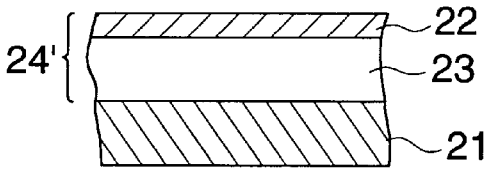
FIG. 2 is a schematic sectional view of the coating device according to the invention.

FIG. 2 is a schematic sectional view of the coating device according to the invention. FIG. 2 shows cylindrical base members 1A and 1B which are piled up in a straight line along a center line Y, and a slide hopper type coating device which successively coats a photoreceptor coating composition 2 onto the above-mentioned cylindrical base members 1A and 1B. A coating composition slide surface 4 of the coating composition 2 is formed so as to surround the above-mentioned cylindrical base member 1A, and a constitution is such that the coating composition 2 supplied to the above-mentioned coating composition slide surface 4 is successively coated onto the above-mentioned cylindrical base member 1A. The coating method is that the above-mentioned circular coating device 3 is fixed, and while elevating the above-mentioned cylindrical base member 1A in the arrow direction along the center line Y, coating is carried out from the upper end portion. The coating composition 2 is supplied to the coating composition slide surface 4 in the above-mentioned coating device 3, in such a way that from the coating composition tank 5 arranged in the exterior, the coating composition 2 is supplied to the above-mentioned circular amount control type coating device through a liquid transport pump 6-1, a liquid transport pipe 6-1', and a coating composition supply section 6A.

The supplied coating composition 2 is then supplied to a ring-shaped coating composition distributing chamber 7; is transported by a coating composition distributing slit 8; is continuously supplied to the above-mentioned coating composition slide surface 4 from an endless coating composition exit 9; is coated onto the whole circumferential surface of the above-mentioned cylindrical base member 1A. Numeral 12 is a liquid storing section which stores the coating composition 2 falling from the above-mentioned coating composition slide surface 4.

Figures 1, 2, 3:
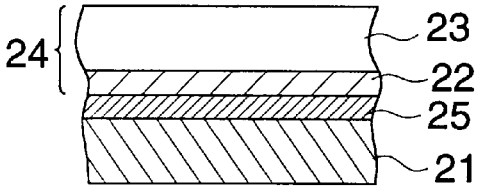
FIG. 3 is a perspective view of the coating device according to the present invention.

FIG. 3 is a perspective view showing the above-mentioned slide hopper type coating device 3 shown in FIG. 2 which is subjected to a partial cutaway.

0101

Figures 1, 2, 3, 4:
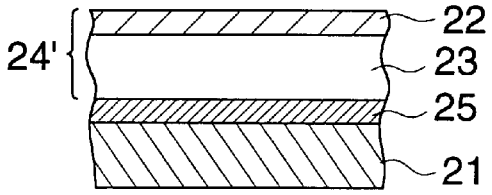
FIG. 4 is a schematic sectional view of the coating device according to the present invention.

FIG. 4 is a schematic sectional view of a coating device showing a simultaneous double-coating method in which coating compositions to become photoreceptors are simultaneously coated onto cylindrical base members 1A and 1B employing the slide hopper type coating device 3. FIG. 4 shows cylindrical base members 1A and 1B piled up on the straight line along a center line Y and a ring-shaped coating device 3 which successively coats the photosensitive coating composition 2 onto the above-mentioned cylindrical base members 1A and 1B. As shown in FIG. 4, a coating composition slide surface 4 of the coating composition 2 and 2A is formed so as to surround the above-mentioned cylindrical base member 1A and it is constituted so as to successively coat the coating compositions 2 and 2A supplied to the above-mentioned coating composition slide surface 4 onto the above-mentioned cylindrical base member 1A. The coating method is that the above-mentioned ring-shaped coating device 3 is fixed, and while elevating the above-mentioned cylindrical base member 1A in the arrow direction along the center line Y, coating is carried out from the upper end portion. The coating compositions 2 and 2A are supplied to the coating composition slide surface 4 in the above-mentioned coating device 3, in such a way that from the coating composition tank 5 arranged in the exterior, the coating composition 2 is conveyed to a coating composition distributing chamber 7 through a liquid transport pump 6-1 and a coating composition supply section 6A.

The coating composition is simultaneously conveyed from a coating composition tank 51 to a coating composition distributing chamber 71.

Thereafter, of supplied coating compositions 2 and 2A, the coating composition 2 is supplied to the ring-shaped coating composition distributing chamber 7 formed in the coating device 3, and the coating composition 2A is supplied to the ring-shaped coating composition distributing chamber 71 formed in the coating device 3. Firstly, the supplied coating composition 2 is continuously supplied to the coating composition slide surface 4 from an endless coating composition exit 9 through the coating composition distributing slit 8; is coated onto the whole circumferential surface of the above-mentioned cylindrical base member 1A.

Further, the above-mentioned coating composition 2A is supplied to the above-mentioned coating composition distributing chamber 71. The supplied coating composition 2A is continuously supplied to the coating composition slide surface 4 from an endless coating composition exit 91 through a coating composition distributing slit 81; is firstly coated onto the whole circumferential surface of the above-mentioned cylindrical base member 1A; on the resulting coating, the coating composition 2A is coated. Numeral 12 is a liquid storing section which stores the coating composition 2 falling from the above-mentioned coating composition slide surface 4.

Figures 1, 2, 3, 4, 5:
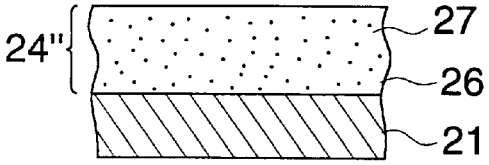
FIG. 5 is a schematic sectional view of the coating device according to the present invention.
Figures 1, 2, 3, 4, 5, 6:
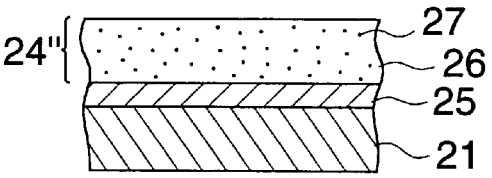
Figure 2:
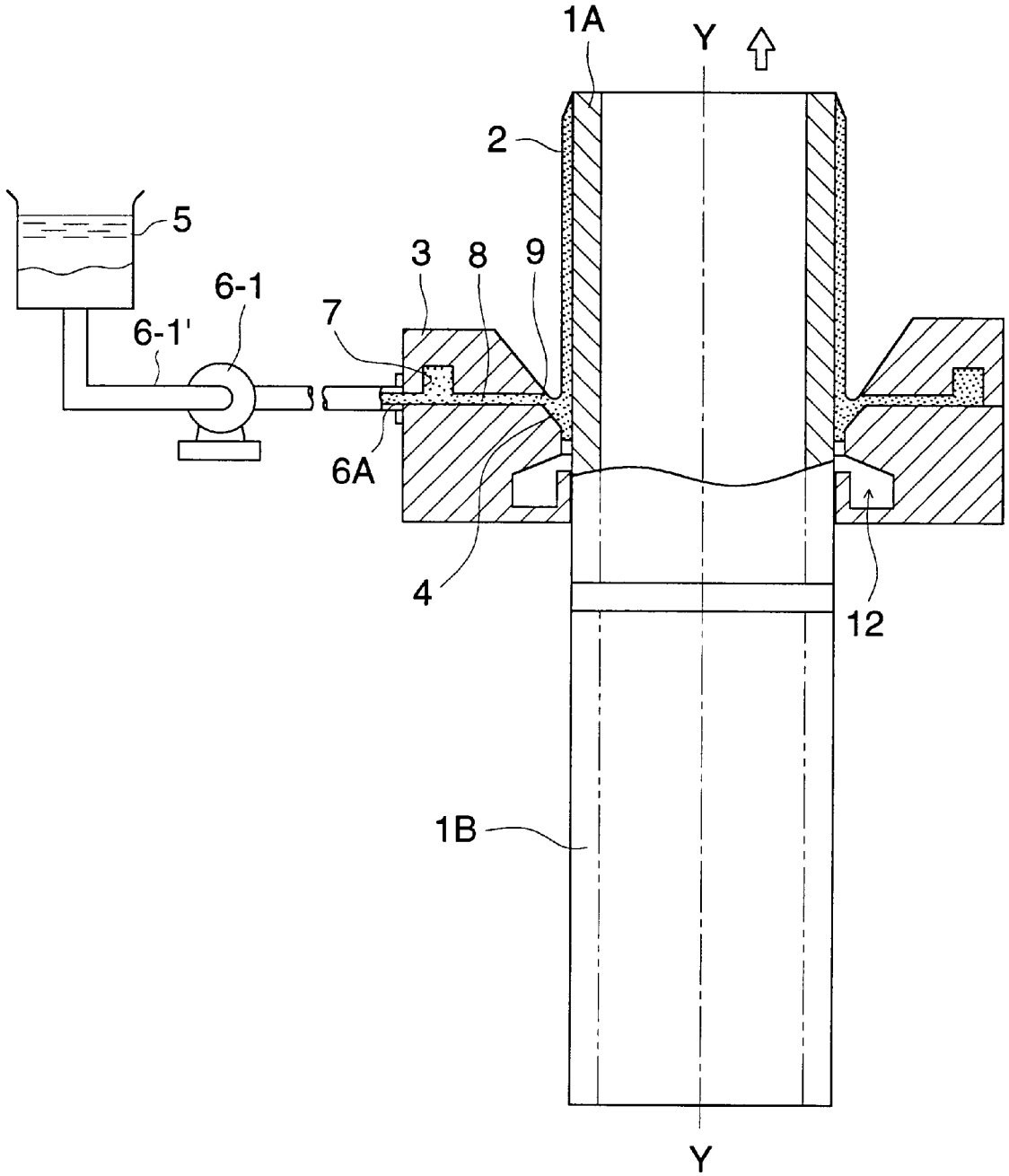
Figure 3:
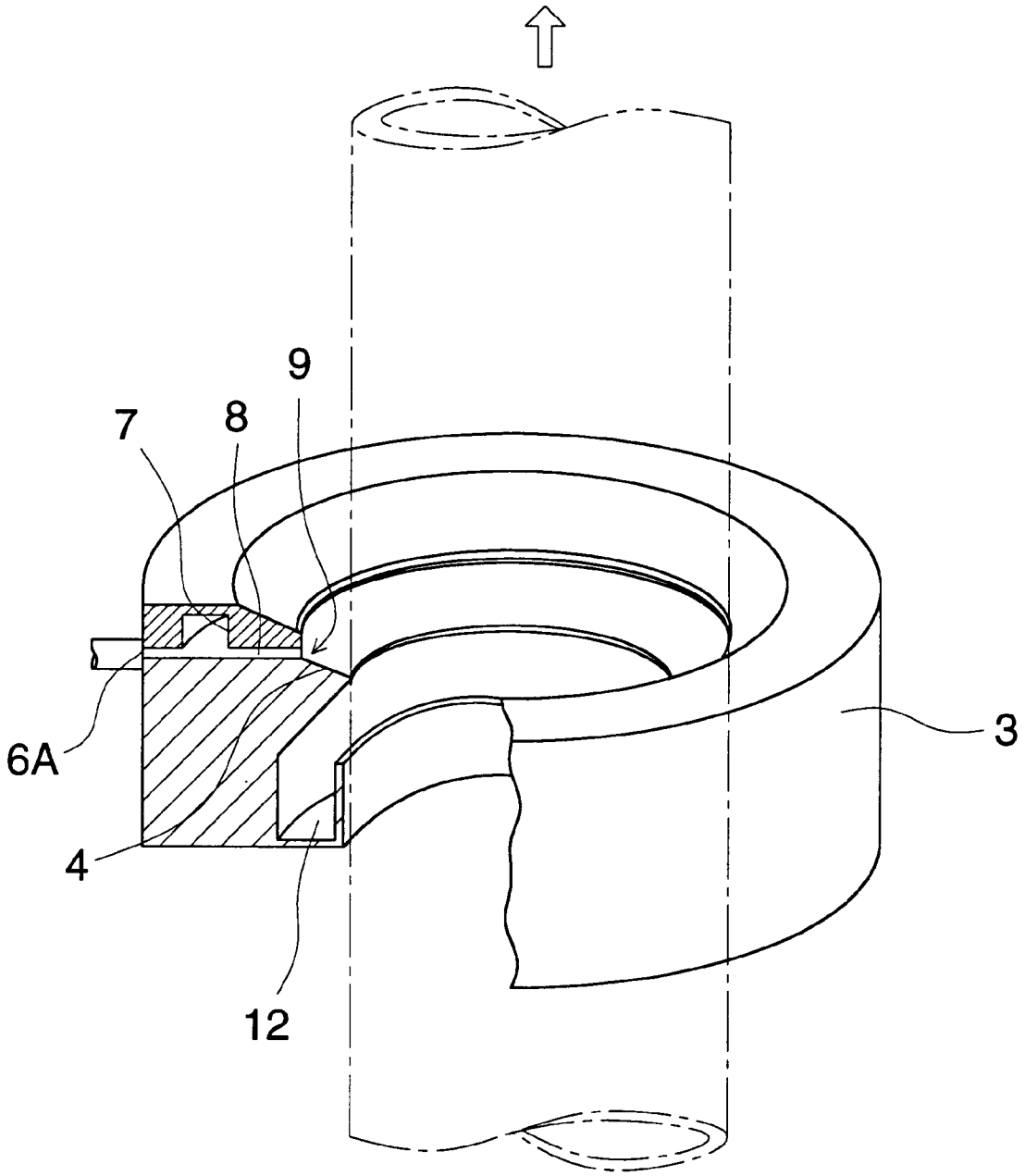
Figure 4:
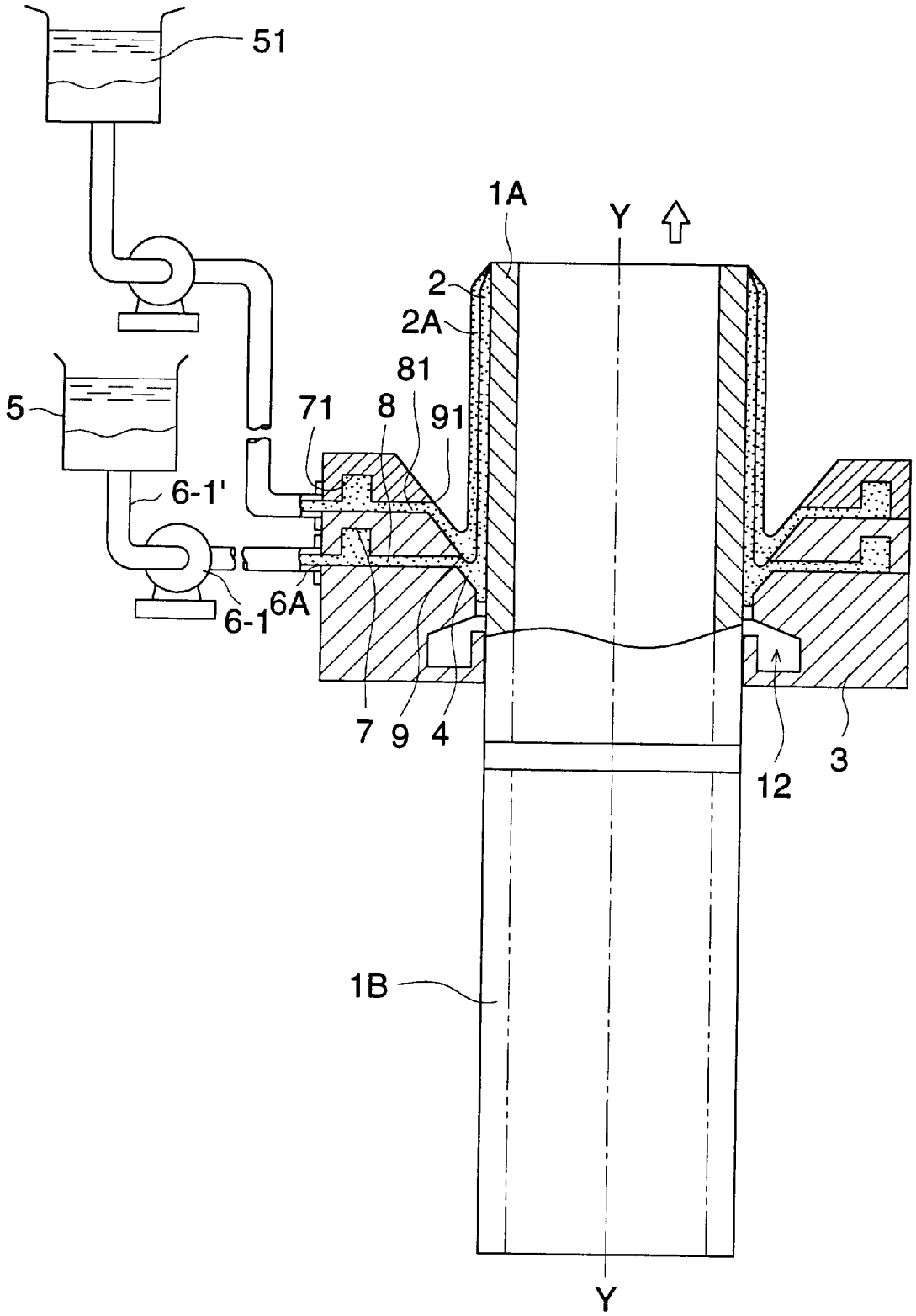
Figure 5:
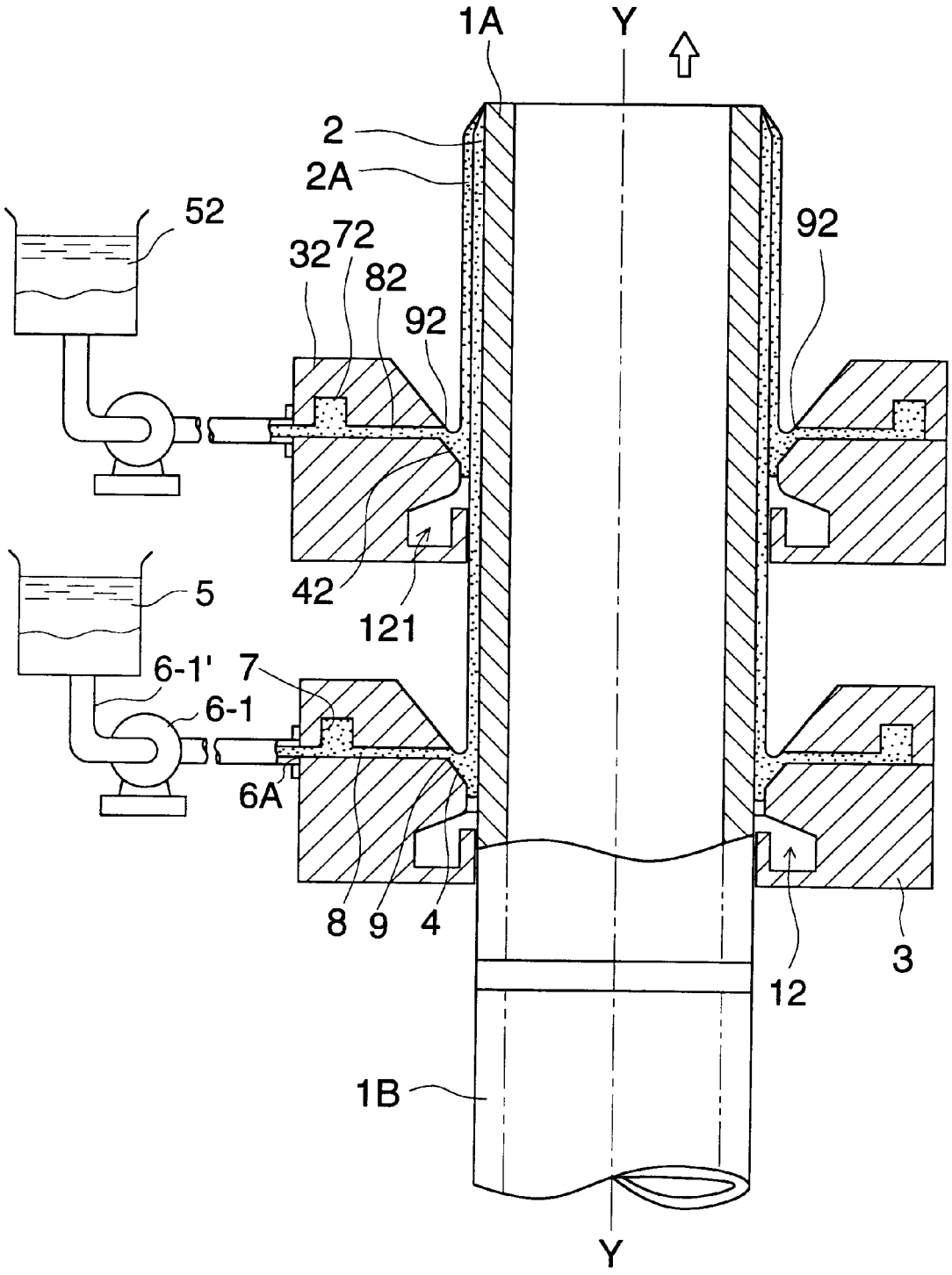

FIG. 5 is a schematic sectional view of a coating device to carry out a successive double-layer coating method in which the coating devices employed in the example of the embodiment in the above-mentioned FIG. 2 are arranged in the upper and lower positions. This is also the example of an embodiment in which coating compositions are subjected to double coating onto the cylindrical base members 1A and 1B formed to be endless, as shown in the above-mentioned FIG. 4.

In the same manner as in the above FIG. 2, firstly, the coating composition 2 supplied to the coating slide surface 4 is coated onto the cylindrical base member 1A. The coating method is that a coating device 3 is fixed, and while elevating the above-mentioned cylindrical base member 1A in the arrow direction along the center line Y, coating is carried out from the upper end portion. The coating compositions 2 is supplied to the coating composition slide surface 4 in the above-mentioned coating device 3, in such a way that from a coating composition tank 5 arranged in the exterior, the coating composition 2 is conveyed to a coating composition distributing chamber 7 through a liquid transport pump 6-1, a liquid transport pipe 6-1', and a coating composition supply section 6A (liquid transport from a coating composition tank 52 to a coating composition distribution chamber is carried out at the same time).

According to this, the coating composition 2A is supplied to a ring-shaped coating composition chamber 7; is continuously supplied to the coating composition slide surface 4 from an endless coating composition exit 9 through a coating composition distributing slit 8 and is coated, as the first layer, onto the whole circumferential surface of the above-mentioned cylindrical base member 1A.

Furthermore, a coating device 32 is provided above the coating device 3. The cylindrical base member 1A subjected to first layer coating of the coating composition 2 is elevated in the arrow direction and is inserted into the place of the coating composition slide surface 42 in the coating device 32. A coating composition 2A supplied to the coating composition slide surface 42 is successively double-coated onto the surface of the coating composition 2 on the above-mentioned cylindrical base member 1A. A coating method is that in the same manner as mentioned above, the coating device 32 is fixed and double-coating is carried out from the upper end portion, while elevating the above-mentioned cylindrical base member 1A in the arrow direction along the center line Y.

The coating composition 2A is supplied to the coating composition slide surface 42 of the above-mentioned ring-shaped coating device 32 in such a way that from a coating composition tank 52 provided in the exterior, a coating composition supplying section of a liquid transport pump is connected with the coating device 32 (the connection method is the same as for the above-mentioned coating device 3). The supplied coating composition 2A is supplied to a ring-shaped coating composition distributing chamber 72 formed in the coating device 32; is continuously supplied to the coating composition slide surface 4 from an endless coating composition exit 92 through a coating composition distributing slit 82 and is coated onto the surface of the coating composition 2 coated onto the above-mentioned cylindrical base member 1A.

The constitution of the photoreceptor of the invention and the production method of the photoreceptor are as mentioned above. Advantages are that because resins employed in the photosensitive layer of the photoreceptor are excellent in mechanical durability, solubility to solvents other than halogen series solvents, compatibility with charge transport materials, and further, water repellency, during production of the photosensitive layer in which conventionally, halogen series solvents have been inevitably employed can be carried out employing halogen-free solvents. Furthermore, the photosensitive layer comprised of the above-mentioned resin exhibits high mechanical durability and in addition, excellent electrical properties such as sensitivity, chargeability, potential stability, etc., and further, excellent image stability during repeated usage at high temperature and humidity.

EXAMPLES

The present invention is explained in detail with reference to examples below.

Synthesis Example 1

Into a solution prepared by dissolving 10 weights part of a phenoxy resin (having a number average molecular weight of 16,000) having a structure mentioned below in 150 weight parts of dried tetrahydrofuran (THF), 2 weight parts of tris(trimethylsiloxy)chlorosilane and 2 weight parts of triethylamine were added and refluxed under nitrogen gas for 5 hours. After carrying out reaction, a reaction product was deposited in a large volume of methanol; was reprecipitated and purified (good solvent: tetrahydrofuran and poor solvent: methanol), and thereafter, was dried to obtain 10 weight parts of a resin. The resulting resin was again dissolved in dried THF; was added with 6 parts of 3-phenylpropionyl chloride; was refluxed under nitrogen gas for 6 hours; thereafter, the reaction product was deposited in a large volume of methanol; was reprecipitated and purified and is then dried to obtain 9 parts of a resin (Exemplified Compound (A-25)).

Synthesis Example 2

Into a solution prepared by dissolving 10 weights part of a phenoxy resin (having a number average molecular weight of 16,000) having a structure mentioned below in 150 weight parts of dried tetrahydrofuran (THF), 2 weight parts of 11H-icosafluoroundecanoyl chloride and 1.5 weight parts of 3-phenylpropionyl chloride were added and refluxed under nitrogen gas for 8 hours. After carrying out reaction, a reaction product was deposited in a large volume of methanol; was reprecipitated and purified (good solvent: tetrahydrofuran and poor solvent: methanol), and thereafter, was dried to obtain 9 weight parts of a resin, Exemplified Compound (A-38).

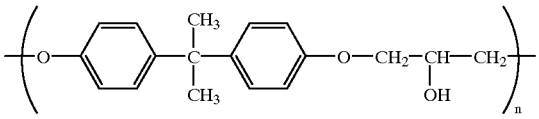

Comparative Synthesis Example

Eight weight parts of a resin was prepared in the same manner as for Synthesis Example, except that as a modifying agent for a phenoxy resin having the above structure, 2 weight parts of 3-phenylpropionyl chloride was only employed instead of 11H-icosafluoroundecanoyl chloride and tris(trimethylsiloxy)chlorosilane.

Example I-1

To 1 weight part of Y-type titanylphthalocyanine having peaks at 9.5°, 24.1°, and 27.2° of Bragg angle 2θ of X-ray diffraction spectra, 100 weight parts of methyl ethyl ketone and 1 weight part of polyvinyl butyral resin were added, and the resulting mixture was dispersed employing a ball mill to obtain a Y-type titanylphthalocyanine dispersion.

On the other hand, on polyester base on which aluminum is evaporated, a 0.5 μm thick interlayer composed of polyamide resin "CX8000" (manufactured by Toray Co.) was provided employing a wire bar coating method and thereafter, the resulting Y-type titanylphthalocyanine dispersion was coated employing a wire bar coating to obtain a 0.3 μm thick charge generating layer.

Next, 0.3 weight part of an isocyanate compound (Exemplified Compound (B-8)) was added to a solution prepared by dissolving 1 weight part of a charge transport material (Exemplified Compound (C-25)) and 1.33 weight parts of a resin of Exemplified Compound (A-3) in 8 weight parts of 2-dichloroethane, and the resulting coating solution was blade-coated on the above-mentioned charge generating layer and was then dried at 100° C. for 2 hours to obtain Example I-1 Photoreceptor having a thickness of 25 μm.

Example I-2

Example I-2 Photoreceptor was prepared in the same manner as for Example I-1, except that when the coating composition of a charge transport layer was prepared, Exemplified Compound (A-1) was employed as a resin, and 0.2 part of an isocyanate compound (Exemplified Compound (B-9)) was employed.

Example I-3

Example I-3 Photoreceptor was prepared in the same manner as for Example I-2, except that when the coating composition of a charge transport layer was prepared, Exemplified Compound (C-24) was employed as a charge transport material; Exemplified compound (A-4) was employed as a rein and Exemplified Compound (B-16) was employed as an isocyanate compound.

Example I-4

Example I-4 Photoreceptor was prepared in the same manner as for Example I-3, except that when the coating composition of a charge transport layer was prepared, Exemplified Compound (A-5) was employed as a resin and 0.35 part of Exemplified Compound (B-29) was employed as an isocyanate compound.

Example I-5

Example I-5 Photoreceptor was prepared in the same manner as for Example I-3, except that when the coating composition of a charge transport layer was prepared, Exemplified Compound (C-8) was employed as a charge transport material and 0.25 part of Exemplified Compound (B-17) was employed as an isocyanate compound.

Example I-6

Example I-6 Photoreceptor was prepared in the same manner as for Example I-5, except that when the coating composition of a charge transport layer was prepared, Exemplified Compound (A-8) was employed as a resin and 0.3 weight part of Exemplified Compound (B-29) was employed as an isocyanate compound.

Example I-7

Example I-7 Photoreceptor was prepared in the same manner as for Example I-3, except that when the coating composition of a charge transport layer was prepared, Exemplified Compound (C-15) was employed as a charge transport material and 0.2 weight part of Exemplified Compound (B-36) was employed as an isocyanate compound.

Example I-8

Example I-8 Photoreceptor was prepared in the same manner as for Example I-7, except that when the coating composition of a charge transport layer was prepared, Exemplified Compound (A-11) was employed as a resin and 0.2 weight part of Exemplified Compound (B-12) was employed as an isocyanate compound.

Comparative Example I-1

Comparative Example I-1 was prepared in the same manner as for Example 1, except that the isocyanate compound (Exemplified Compound (B-8)) was not added.

Comparative Example I-2

Comparative Example I-2 was prepared in the same manner as for Example 3, except that the isocyanate compounds (Exemplified Compound (B-16)) was not added.

Comparative Example I-3

Comparative Example I-3 was prepared in the same manner as for Example 6, except that the isocyanate compound (Exemplified Compound (B-29)) was not added.

Comparative Example I-4

Comparative Example I-4 was prepared in the same manner as for Example 7, except that the isocyanate compound (Exemplified Compound (B-36)) was not added.

Comparative Example 1-5

Comparative Example I-5 Photoreceptor was prepared in the same manner as for Example I-1, except that 0.1 weight part of a 1% silicone Oil KF-54 (manufactured by Shin-Etsu Kagaku Kogyo Co.) dichloroethane solution was added to a solution prepared by dissolving, in 8 weight parts of 1,2-dichloroethane, 1 part of Exemplified Compound (C-25) as a charge transport material, and 1.33 weight parts of polycarbonate having structure mentioned below as a resin.

(D-1)

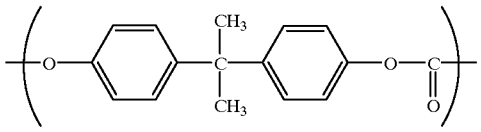

(D-2)

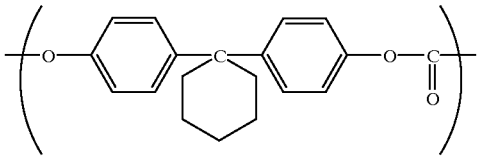

(D-3)

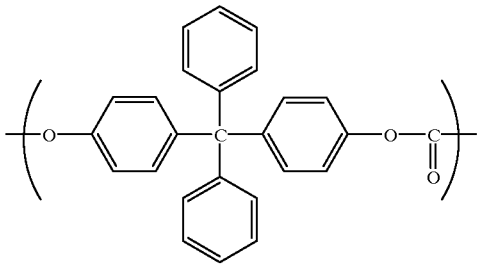

(D-4)

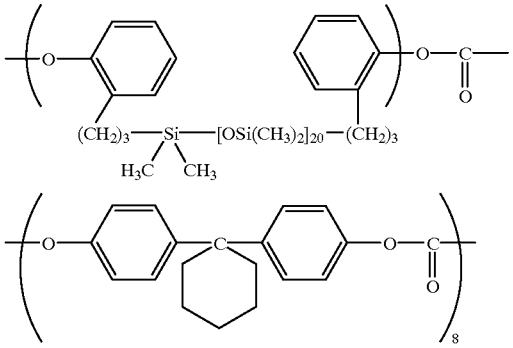

Comparative Example I-6

Comparative Example I-6 Photoreceptor was prepared in the same manner as for comparative Example I-5, except that a compound having a structural formula (D-2) mentioned above was employed instead of the polycarbonate resin (D-1).

Comparative Example I-7

Comparative Example I-7 Photoreceptor was prepared in the same manner as for Comparative Example I-5, except that a compound having a structural formula (D-3) mentioned above was employed instead of the polycarbonate resin (D-1).

Comparative Example I-8

Comparative Example I-8 Photoreceptor was prepared in the same manner as for comparative Example I-5, except that a compound having a structural formula (D-4) mentioned above was employed instead of the polycarbonate resin (D-1).

Evaluation I-1

Each Photoreceptor of the above-mentioned Examples I-1 through I-8 and Comparative Examples I-1 through I-8 was cut into a circle having a diameter of 12.5 cm and the surface of each resulting sample was abraded under conditions of load 500 g, abrasion ring CS-5, rotation speed 70 rpm at ambient conditions of temperature of 20° C. and humidity 50% employing a Teber Abrasion Tester (manufactured by Toyo Seiki Co.) The weight of the sample was measured before and after abrasion and the difference in weight before and after abrasion was termed "abrasion weight". The abrasion weight was converted to a layer thickness as follows.

Weight per unit layer thickness=cut sample area×layer thickness×specific gravity of resin/layer thickness Abraded layer thickness=abrasion weight/weight per unit layer thickness Area of cut sample: 122.45 $cm^2$ Layer thickness: 0.0025 cm Specific gravity of resin: 1.2

Weight per unit layer thickness=14.7 mg/$\mu$m

Furthermore, water contact angles before and after abrasion were measured according to a liquid drop method, employing a Contact Angle Measuring Machine CA-DT-A Type (manufactured by Kyowa Kaimen Kagaku Co.).

Furthermore, instead of the aluminum-evaporated polyester base, each Photoreceptor of Examples I-1 through I-8 and Comparative Examples I-1 trough I-8 was prepared on an aluminum drum. Each Photoreceptor was mounted to a modified Digital Copier "Konica 7728" (manufactured by Konica Corp.) and image formation was carried out and the formation of white streaks due to adhesion on a print image after 20,000 prints were inspected.

The white streak defect due to dust adhesion is referred to an image defect (shaped like a white streak) supposedly formed due to the adhesion of toner, paper dust, etc.

These results are shown in Table 1.

TABLE 1

| EMBODIMENT | ABRASION WEIGHT (mg) | ABRASION LAYER THICKNESS ($\mu$m) | CONTACT ANGLE (°) (before abrasion) | CONTACT ANGLE (°) (after abrasion) | IMAGE QUALITY AFTER 20,000 PRINTS |
|---|---|---|---|---|---|
| Example I-1 | 0.7 | 0.05 | 102 | 98 | A |
| Example I-2 | 0.6 | 0.04 | 100 | 96 | A |
| Example I-3 | 0.5 | 0.03 | 103 | 98 | A |
| Example I-4 | 0.7 | 0.05 | 99 | 95 | A |
| Example I-5 | 0.8 | 0.05 | 99 | 95 | A |
| Example I-6 | 0.6 | 0.04 | 101 | 96 | A |
| Example I-7 | 0.7 | 0.05 | 100 | 96 | A |
| Example I-8 | 0.8 | 0.05 | 102 | 99 | A |
| Comparative Example I-1 | 5.8 | 0.39 | 102 | 96 | A |
| Comparative Example I-2 | 4.8 | 0.32 | 103 | 95 | A |
| Comparative Example I-3 | 5.9 | 0.40 | 101 | 94 | A |
| Comparative Example I-4 | 5.6 | 0.38 | 100 | 95 | A |
| Comparative Example I-5 | 1.8 | 0.12 | 98 | 86 | B |
| Comparative Example I-6 | 3.4 | 0.23 | 95 | 83 | B |
| Comparative Example I-7 | 2.1 | 0.14 | 99 | 88 | B |
| Comparative Example I-8 | 2.8 | 0.19 | 100 | 89 | B |

As shown in Table 1, Photoreceptors of Comparative Examples exhibit large decrease in layer thickness due to abrasion, and large formation of white streak-like image defects due to paper dust. On the other hand, the photoreceptors exhibit minimized decrease in layer thickness due to abrasion and excellent image quality caused no white streak image defects.

Example II-1

To 1 weight part of Y-type titanylphthalocyanine having peaks at 9.5°, 24.1°, and 27.2° of Bragg angle 2θ, 100 weight parts of methyl ethyl ketone and 1 weight part of polyvinyl butyral resin were added and the resulting mixture was dispersed employing a ball mill to obtain a Y-type titanylphthalocyanine dispersion.

On an aluminum drum, a 0.5 $\mu$m thick interlayer comprised of polyamide resin "CM8000" (manufactured by Toray Co.) is provided, and on the resulting layer, the prepared Y-type titanylphthalocyanine dispersion was then coated to obtain a charge generating layer with 0.3 $\mu$m thickness. Subsequently, a solution was prepared by dissolving 1 weight part of a charge transport material (Exemplified Compound (C-25)) and 1.33 weight parts of resin prepared by Synthesis Example (Exemplified Compound (A-25)) in 8 weight parts of methyl ethyl ketone. To 100 weight parts of this coating solution, 2.0 weight parts of an isocyanate compound (Exemplified Compound (B-8)) was added, and the resulting solution was employed for dip coating. The resulting coating was dried at 100° C. for 2 hours to form a charge transport layer with a thickness of 25 $\mu$m. Thus, Example II-1 Photoreceptor was obtained.

Comparative Example II-1

Comparative Example II-1 Photoreceptor was prepared in the same manner as for Example II-1, except that in Example II-1, instead of the resin obtained by Synthesis Example, the resin obtained by Comparative Synthesis Example was employed.

Example II-2

Example II-2 Photoreceptor was prepared in the same manner as for Example II-1, except that when the coating composition of a charge transport layer was prepared, Exemplified Compound (A-21) was employed as a resin; Exemplified Compound (B-16) was employed as an isocyanate compound, and Exemplified Compound (C-24) was employed as a charge transport compound.

Example II-3

Example II-3 Photoreceptor was prepared in the same manner as for Example II-2, except that when the coating composition of a charge transport layer was prepared, Exemplified Compound (B-29) was employed as an isocyanate compound.

Example II-4

Example II-4 Photoreceptor was prepared in the same manner as for Example II-1, except that when the coating composition of a charge transport layer was prepared, Exemplified Compound (A-26) was employed as a resin.

Evaluation II-1

Each Photoreceptor of the above-mentioned Example II-1 through II-4 and Comparative Example II-1 was mounted to a modified Digital Copier "Konica 7728" (manufactured by Konica Corp.), and at conditions of a temperature of 30° C. and a humidity of 80%, image formation was carried out upon adjusting grid voltage VG of the charging device to 800 volts, and potential VH of an unexposed part and potential VL of a part exposed with light of 0.7 mW were measured. Thereafter, after carrying out 20,000 repeated printing, VH and VL were measured.

The results are shown in Table 2.

TABLE 2

| | INITIAL | | AFTER 20,000 PRINTS | | |
|---|---|---|---|---|---|
| Sample | VH (V) | VL (V) | VH (V) | VL (V) | ΔVL |
| Example II-1 | −798 | −87 | −786 | −102 | 15 |
| Example II-2 | −783 | −82 | −772 | −106 | 24 |
| Example II-3 | −788 | −90 | −769 | −110 | 20 |
| Example II-4 | −790 | −85 | −783 | −103 | 18 |
| Comparative Example II-1 | −783 | −100 | −738 | −151 | 51 |

Based on Table 2, it is seen that by employing the resins as those for charge transport layers of a photoreceptor, excellent potential properties are exhibited, and stable and excellent potential properties are maintained during the initial period and repeated usage at high temperature and humidity. On the contrary, the Comparative Photoreceptor exhibits remarkable degradation of potential properties during repeated image formation at high temperature and humidity.

Example II-5

Example II-5 Photoreceptor was prepared in the same manner as for Example II-2, except that a charge transfer layer was coated employing a slide hopper type coating device instead of dip coating. The resulting Photoreceptor was mounted to the modified Digital Copier "Konica 7728" (manufactured by Konica Corp.) which was the same copier employed in Evaluation II-1. Under the same conditions, 20,000 prints were prepared and obtained prints were compared to the image sample and no image defect was observed in medium contrast images.

Example II-6

Example II-6 Photoreceptor only comprising a charge transport layer with 25 μm thickness was prepared in such a manner that the same charge transport layer coating composition as Example II-1 was prepared; was blade-coated on polyester base onto which aluminum was evaporated, and was dried at 100° C. for 2 hours.

Comparative Example II-2

Comparative Example II-2 Photoreceptor was prepared in the same manner as for Example II-6, except that the resin obtained by Comparative Synthesis Example was employed instead of the resin obtained by Synthesis Example.

Evaluation II-2

Each sample of the above-mentioned Example II-6 and Comparative Example II-2 was cut into a circle having a diameter of 12.5 cm and the surface of each resulting sample was abraded under conditions of load 500 g, abrasion ring CS-5, rotation speed 70 rpm at ambient conditions of temperature of 20° C. and humidity 50% employing a Teber Abrasion Tester (manufactured by Toyo Seiki Co.) The weight of the sample was measured before and after abrasion and the difference in weight before and after abrasion was termed "abrasion weight". The results are shown in Table 3.

TABLE 3

| Sample | ABRASION WEIGHT (mg) |
|---|---|
| Example II-6 | 0.3 |
| Comparative Example II-2 | 5.8 |

Example II-6 Photoreceptor of the invention exhibits extremely small abrasion weight. On the contrary, Comparative Example II-2 Photoreceptor out of the invention exhibits very large abrasion weight. Thus, the advantage of the invention is clearly seen.

As is demonstrated in Example, when the resin of the invention is employed, an electrophotographic photoreceptor can be prepared which exhibits excellent potential properties at high temperature and humidity. Furthermore, by hardening the resin, an electrophotographic photoreceptor can be prepared which exhibits high mechanical durability and high imaging durability at high temperature and humidity. Furthermore, when the photoreceptor is prepared employing a circular amount control type coating device, advantages are obtained in which image defects are minimized during initial usage of the photoreceptor and after the repeated usage at high temperature and humidity.

Example III-1

To 1 weight part of Y-type titanylphthalocyanine having peaks at 9.5°, 24.1°, and 27.2° of Bragg angle 2θ of X-ray diffraction spectra, 100 weight parts of methyl ethyl ketone and 1 weight part of polyvinyl butyral resin were added, and the resulting mixture was dispersed employing a ball mill to obtain a Y-type titanylphthalocyanine dispersion.

On an aluminum drum, a 0.5 μm thick interlayer comprised of polyamide resin "CM8000" (manufactured by Toray Co.) was provided employing dip coating, and the resulting Y-type titanylphthalocyanine dispersion was then coated to obtain a 0.3 μm thick charge generating layer. Next, a solution was prepared by dissolving 1 weight part of a charge transport material (Exemplified Compound (T-21)) and 1.33 weight parts of a resin (Exemplified Compound A-38)) obtained by Synthesis Example in 8 weight parts of tetrahydrofuran. To 100 weight parts of this resulting coating solution, 2.0 weight parts of an isocyanate compound (Exemplified Compound (B-7)) was added and was dip-coated, and was dried at 100° C. for 1.5 hours to obtain Example III-1 Photoreceptor upon forming a 25 μm thick charge transport layer.

Comparative Example III-1

Comparative Example III-1 Photoreceptor was prepared in the same manner as for Example III-1, except that a resin obtained by Comparative Synthesis Example was employed instead of a resin obtained by Synthesis Example.

Example III-2

Example III-2 Photoreceptor was prepared in the same manner as for Example III-1, except that when the coating composition of a charge transport layer was prepared, Exemplified Compound (A-33) was employed as a resin; Exemplified Compound (B-9) was employed as an isocyanate compound, and Exemplified Compound (C-1) was employed as a charge transport material.

Example III-3

Example III-3 Photoreceptor was prepared in the same manner as for Example III-2, except that when the coating composition of a charge transport layer was prepared, Exemplified Compound (A-35) was employed as a resin and Exemplified Compound (B-16) was employed as an isocyanate compound.

Example III-4

Example III-4 Photoreceptor was prepared in the same manner as for Example III-1, except that when the coating composition of a charge transport layer was prepared, Exemplified Compound (A-39) was employed as a resin and Exemplified Compound (B-16) was employed as an isocyanate compound.

Evaluation III-1

Each Photoreceptor of the above-mentioned Example III-1 through III-4 and Comparative Example III-1 was mounted to a modified Digital Copier "Konica 7728" (manufactured by Konica Corp.), and at conditions of a temperature of 30° C. and a humidity of 85%, image formation was carried out upon adjusting grid voltage VG of the charging device to 800 volts, and potential VH of an unexposed part and potential VL of a part exposed with light of 0.7 mW were measured.

Thereafter, after carrying out 20,000 repeated printing for image formation, VH and VL were measured, and the results are shown in Table 4.

TABLE 4

| | INITIAL | | AFTER 20,000 PRINTS | | |
|---|---|---|---|---|---|
| Sample | VH (V) | VL (V) | VH (V) | VL (V) | ΔVL |
| Example III-1 | −786 | −86 | −776 | −104 | 18 |
| Example III-2 | −782 | −81 | −773 | −103 | 22 |
| Example III-3 | −790 | −90 | −782 | −113 | 23 |
| Example III-4 | −783 | −84 | −766 | −103 | 19 |
| Comparative Example III-1 | −785 | −99 | −736 | −153 | 54 |

Based on Table 4, it is seen that Photoreceptors comprised of resins as those for a charge transport layer exhibit excellent potential properties and maintain stable and excellent potential properties during initial usage and after repeated usage at high temperature and humidity. On the contrary, the Comparative Photoreceptor exhibits degraded potential properties during repeated image formation at high temperature and humidity.

Example III-5

Example III-5 Photoreceptor was prepared in the same manner as for Example III-1, except that a charge transport layer was coated employing a slide hopper type coating device instead of dip-coating.

This resulting photoreceptor was mounted to the same modified Digital Copier "Konica 7728" (manufactured by Konica Corp.) as that for Evaluation III-1; under the same conditions, 20,000 prints were carried out; were compared with the image sample, and no image defect in medium contrast images was observed.

Example III-6

In the same manner as for Example III-2, a charge transfer layer coating composition was prepared and was blade-coated onto polyester base onto which aluminum was evaporated and was dried at 100° C. for 2 hours. Thus, Example III-6 Photoreceptor only composed of a charge transport layer with 25 μm thickness was prepared.

Comparative Example III-2

Comparative Example III-2 Photoreceptor was prepared in the same manner as for Example III-6, except that a resin obtained by Comparative Synthesis Example was employed instead of a resin obtained by Synthesis Example.

Evaluation III-2

Each sample of the above-mentioned Example III-6 and Comparative Example III-2 was cut into a circle having a diameter of 12.5 cm and the surface of each resulting sample was abraded under conditions of load 500 g, abrasion ring CS-5, rotation speed 70 rpm at ambient conditions of temperature of 20° C. and humidity 50% employing a Teber Abrasion Tester (manufactured by Toyo Seiki Co.) The weight of the sample was measured before and after abrasion and the difference in weight before after abrasion was termed "abrasion weight". The results are shown in Table 5.

TABLE 5

| Sample | ABRASION WEIGHT (mg) |
|---|---|
| Example III-6 | 1.2 |
| Comparative Example III-2 | 6.8 |

As is clearly seen in Table 5, the difference in abrasion weights of Photoreceptors and out of the invention is found extremely large.

The present invention can provide an electrophotographic photoreceptor which exhibits high mechanical durability, and improved cleaning and paper dust adhesion properties. In addition to these performances, the present invention can provide a photoreceptor which exhibits excellent compatibility with a charge transport material and minimized effect of humidity on the electrical properties.

What is claimed is:

1. An electrophotographic photoreceptor comprising a support having a photosensitive layer, wherein the topmost layer of the photoreceptor is a charge transport layer, and comprises charge transport material and a binder comprising a crosslinked resin having, as a recurring unit, (a) a portion comprising a constituent having a fluorine or silicon atom at the side chain, (b) a portion having an aromatic group in the main or side chain, and (c) a portion having a hydroxyl group or an amino group.

2. The electrophotographic photoreceptor of claim 1 wherein water contact angle of the photosensitive layer is not less than 90 degrees.

3. The electrophotographic photoreceptor of claim 1 wherein the resin is crosslinked by employing a two or more valent or higher valent isocyanate compound crosslinking agent.

4. The electrophotographic photoreceptor of claim 3 wherein the resin is crosslinked by employing a divalent isocyanate compound crosslinking agent.

5. The electrophotographic photoreceptor of claim 1 wherein a resin before crosslinking comprises at least one of a partial structure represented by general formulas (1) through (8);

General Formula (1)

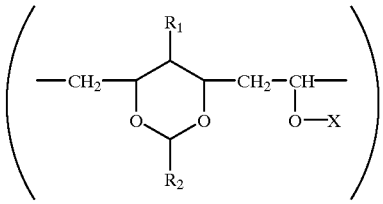

General Formula (2)

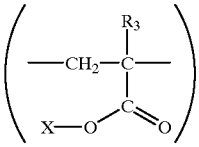

General Formula (3)

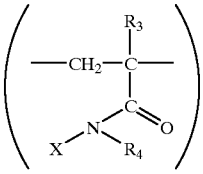

General Formula (4)

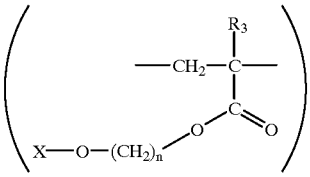

General Formula (5)

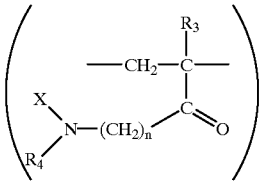

General Formula (6)

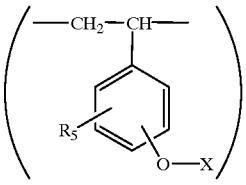

-continued

General Formula (7)

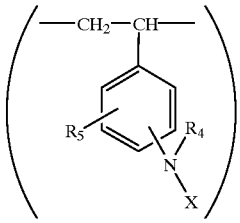

General Formula (8)

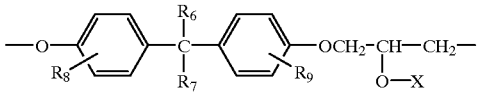

wherein $R_1$ and $R_2$ each is an alkyl group or an aryl group;

X is a hydrogen atom, or an alkyl group, an aryl group, or an organic group comprising a fluorine or silicon atom, each of which groups may combine directly or indirectly via a carbonyl group.

$R_3$ is a hydrogen atom or an alkyl group having from 1 to 3 carbon atoms;

$R_4$ is a hydrogen atom, an alkyl group, or an aryl group;

$R_5$ is a hydrogen atom, a halogen atom, an alkyl group having from 1 to 4 carbon atoms, an aryl group, or an alkoxy group, and the number of $R_5$ may be 1 or more, while n is a positive integer;

$R_6$ and $R_7$ each is a hydrogen atom, an alkyl group or an aryl group and $R_6$ and $R_7$ may combine with each other to form a ring;

$R_8$ and $R_9$ each is a hydrogen atom, a halogen atom, an alkyl group, an aryl group, or an alkoxy group, and the number of $R_8$ and $R_9$ each may be 1 or more.

6. The electrophotographic photoreceptor of claim 5 wherein X is an alkyl or aryl group substituted by one or more fluorine atoms or a group represented by a formula;

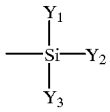

wherein $Y_1$, $Y_2$, and $Y_3$ each is an alkyl group, an aryl group or $—SiY_{11}Y_{21}Y_{31}$, wherein each of $Y_{11}$, $Y_{21}$ and $Y_{31}$ is an alkyl or aryl group.

7. The electrophotographic photoreceptor of claim 5 wherein a resin before crosslinking comprises a partial structure represented by general formula (8).

8. The electrophotographic photoreceptor of claim 1 wherein the topmost layer is provided by coating composition comprising a resin, before crosslinking, and an isocyanate compound having two functional groups or more per molecule is coated employing a circular flow amount control coating device.

9. The electrophotographic photoreceptor of claim 1 wherein the photosensitive layer has a charge generation layer under the charge transport layer.

10. The electrophotographic photoreceptor of claim 9 wherein the support is electroconductive, an interlayer is provided between the charge generation layer and the support.

* * * * *

UNITED STATES PATENT AND TRADEMARK OFFICE

CERTIFICATE OF CORRECTION

PATENT NO. : 6,099,998 
DATED : August 8, 2000
INVENTOR(S) : Toyoko Shibata et al.

It is certified that error appears in the above-identified patent and that said Letters Patent is hereby corrected as shown below:

Columns 13 &14,
Example (A-19), delete "

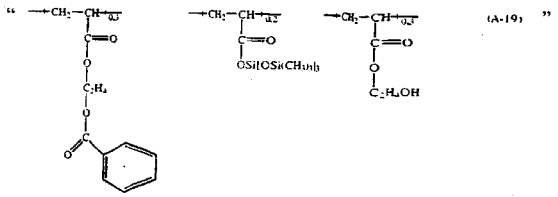

and insert therefor --

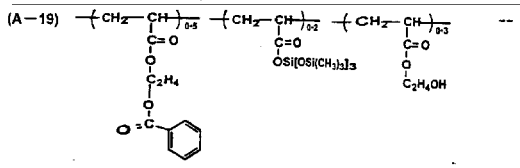

--

Columns 15 & 16,
Example (A-22), delete "

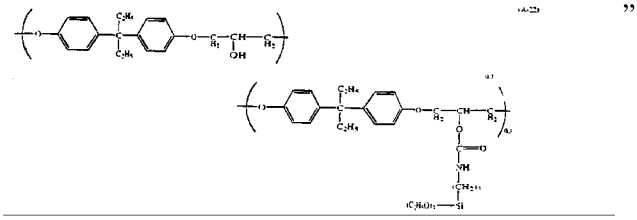

and insert therefor --

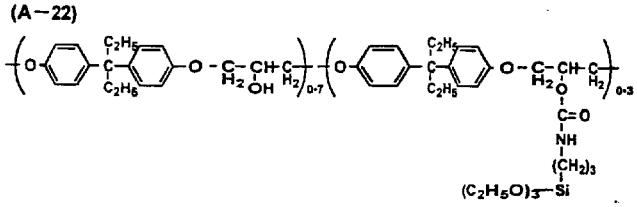

--

Column 27,
Line 31, after "out" insert -- by --

Column 32,
Line 39, after "further," delete "X-" and insert therefor -- X-type --

UNITED STATES PATENT AND TRADEMARK OFFICE

CERTIFICATE OF CORRECTION

PATENT NO. : 6,099,998 
DATED : August 8, 2000
INVENTOR(S) : Toyoko Shibata et al.

It is certified that error appears in the above-identified patent and that said Letters Patent is hereby corrected as shown below:

Column 47,
Line 10, after “coating” (first occurrence) insert -- , --
Line 14, delete “a” (first occurrence)
Line 28, delete “effect” and insert therefor -- effects --

Column 50,
Line 26, after “10” delete “weight part” and insert therefor -- weight parts --
Line 61, after “resin” delete “”CX8000"” and insert therefor -- “CM8000" --

Column 51,
Line 21, after “a” delete “rein” and insert therefor -- resin --

Column 52,
Example (D-4), delete “

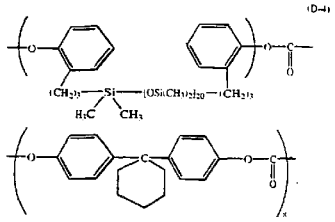

”

and insert therefor -- (D−4)

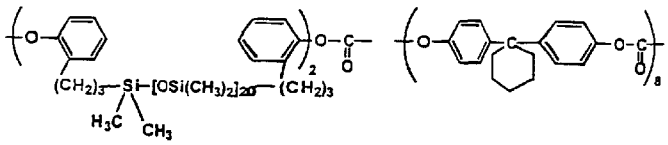

--

UNITED STATES PATENT AND TRADEMARK OFFICE

CERTIFICATE OF CORRECTION

PATENT NO. : 6,099,998
DATED : August 8, 2000
INVENTOR(S) : Toyoko Shibata et al.

It is certified that error appears in the above-identified patent and that said Letters Patent is hereby corrected as shown below:

Column 53,
Line 33, after "I-1" delete "trough" and insert therefor -- through --
Line 40, before "an" insert -- as --

Column 56,
Line 41, after "demonstrated" delete "in Example"

Signed and Sealed this

Seventeenth Day of August, 2004

JON W. DUDAS
*Acting Director of the United States Patent and Trademark Office*